US012582182B2

(12) United States Patent
Anson et al.

(10) Patent No.: US 12,582,182 B2
(45) Date of Patent: Mar. 24, 2026

(54) GARMENT WAIST POCKET WITH POCKET RETAINER

(71) Applicant: Amer Sports Canada Inc., North Vancouver (CA)

(72) Inventors: Ashley B. Anson, Milwaukie, OR (US); Nelle Horsley, North Vancouver (CA)

(73) Assignee: Amer Sports Canada Inc., North Vancouver (CA)

( * ) Notice: Subject to any disclaimer, the term of this patent is extended or adjusted under 35 U.S.C. 154(b) by 77 days.

(21) Appl. No.: 18/372,530

(22) Filed: Sep. 25, 2023

(65) Prior Publication Data

US 2025/0098802 A1 Mar. 27, 2025

(51) Int. Cl.
*A41D 27/20* (2006.01)

(52) U.S. Cl.
CPC ..... *A41D 27/207* (2013.01); *A41D 27/201* (2013.01)

(58) Field of Classification Search
CPC .... A41D 27/20; A41D 27/201; A41D 27/202; A41D 27/204; A41D 27/205; A41D 27/207
See application file for complete search history.

(56) References Cited

U.S. PATENT DOCUMENTS

| | | | | |
|---|---|---|---|---|
| 754,948 | A | 3/1904 | White | |
| 2,883,673 | A * | 4/1959 | Solomon | A41D 27/207 2/253 |
| 6,772,446 | B1 | 8/2004 | Black | |
| 8,028,345 | B2 | 10/2011 | Waite et al. | |
| 8,321,964 | B2 | 12/2012 | Gernes | |
| 9,021,615 | B2 | 5/2015 | Cockram | |
| 9,254,010 | B2 | 2/2016 | Hendrick | |
| D754,948 | S | 5/2016 | Cockram | |
| 9,961,947 | B2 | 5/2018 | Cockram | |
| 11,291,257 | B2 | 4/2022 | Fernette | |
| 2013/0048687 | A1 | 2/2013 | Do | |
| 2013/0276210 | A1 | 10/2013 | Clarke et al. | |
| 2014/0196194 | A1 | 7/2014 | Clarke et al. | |
| 2016/0143424 | A1 | 5/2016 | Stephens et al. | |
| 2016/0331053 | A1 * | 11/2016 | Gordon | A41D 7/00 |
| 2018/0035736 | A1 | 2/2018 | Le | |

(Continued)

FOREIGN PATENT DOCUMENTS

| | | |
|---|---|---|
| CN | 2312593 Y | 4/1999 |
| CN | 205695808 U | 11/2016 |

(Continued)

OTHER PUBLICATIONS

Image of web page (https://flipbelt.com/products/running-pants-cropsl) showing FLIPBELT Women's Running Crops. Web page image retrieved on Jun. 6, 2023.

*Primary Examiner* — Khoa D Huynh
*Assistant Examiner* — Erick I Lopez
(74) *Attorney, Agent, or Firm* — Terence P. O'Brien; Todd A. Rathe

(57) ABSTRACT

A garment may include a waistband, a lower extension extending downward from the waistband, an upward facing waist pocket along an exterior of the waistband, the upward facing waist pocket having an interior and a bottom and a pocket retainer within the upward facing waist pocket and forming an internal retention space having a retention space mouth.

13 Claims, 16 Drawing Sheets

(56) References Cited

U.S. PATENT DOCUMENTS

| | | | | |
|---|---|---|---|---|
| 2018/0220720 | A1 | 8/2018 | Cockram | |
| 2019/0297972 | A1* | 10/2019 | Holmes | A41F 9/025 |
| 2020/0245704 | A1 | 8/2020 | Hogberg | |
| 2021/0378337 | A1* | 12/2021 | Camm | A41D 27/205 |

FOREIGN PATENT DOCUMENTS

| | | |
|---|---|---|
| CN | 215873511 U | 2/2022 |
| EP | 4030951 | 7/2022 |
| WO | 2021052773 | 3/2021 |

* cited by examiner

GARMENT WAIST POCKET WITH POCKET RETAINER

BACKGROUND

Garments, also known as apparel, clothing or the like, sometimes include one or more pockets. Some pockets extend along and partially about the waist of the person wearing the garment. During exercise or other activities, contents of the pockets may sometimes be dislodged and may inadvertently fall out of the pockets.

Figure 1:
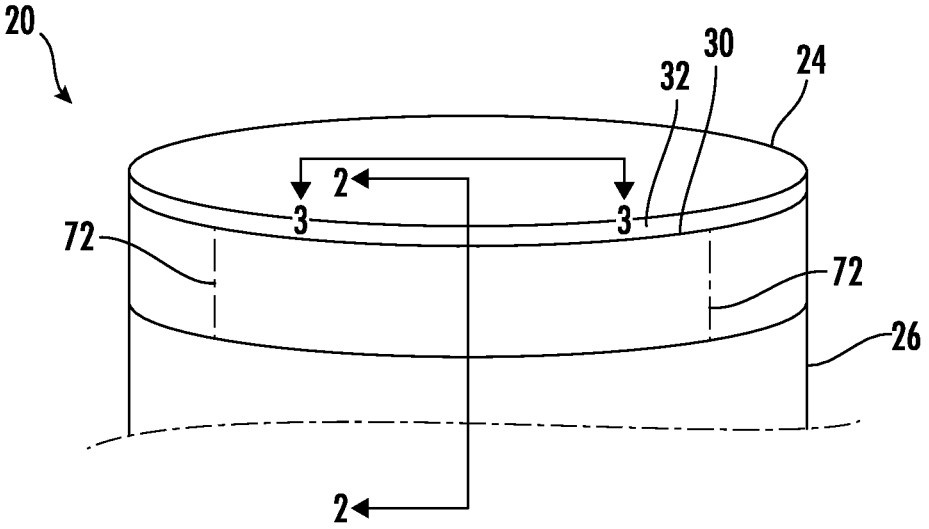
FIG. 1 is a fragmentary perspective view illustrating portions of an example garment.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example garments that provide enhanced retention of articles placed within a waist pocket. The example garments comprise an elongate upward facing waist pocket that extends in an oval or circular fashion along and about the waistline of the garment. The waist pocket has an internal floor or bottom and a top opening through which articles may be placed within the waist pocket.

The example garments further comprise a pocket retainer disposed within the upward facing waist pocket. The pocket retainer comprises an internal panel that forms an internal retention space within the waist pocket, wherein articles may be placed into the internal retention space through a retention space mouth. The pocket retainer may be sized or may be at least partially elastic to grip and engage the received articles so as to assist in retaining the articles within the waist pocket by inhibiting such articles from rising and falling out of the waist pocket through the top opening of the waist pocket. The pocket retainer may be especially useful for providing enhanced gripping of smaller items which may otherwise be more likely fall out of the waist pocket through the top opening. For example, such pocket retainers may be well suited for assisting in the retention of a phone, keys or the like.

In some implementations, those edge portions of the pocket retainer proximate to the mouth or each of the mouths of the retention space are elastic so as to resiliently close against or about any articles positioned within the retention space. In some implementations, edge portions of the pocket retainer are made from an elastic material. In some implementations, such edge portions are made elastic through the addition of an elastic strip or band secured to the pocket retainer along such edges. In some implementations, an entirety of the pocket retainer is formed from an elastic material such that the entirety of the pocket retainer resiliently stretches and grips articles positioned within the retention space.

In some implementations, the retention space continuously extends along the waistband without interruption, 360 degrees around the waist of the person wearing the garment. In such implementations, selected portions of the pocket retainer may be stitched, bonded or otherwise affixed to either the waistband or portions of the panel forming an exterior of the upward facing waist pocket at vertically spaced locations such that the retention space comprises a continuous uninterrupted passage extending 360 degrees about the waist of the person wearing the garment, wherein portions of the passage may extend between the vertically spaced locations. In some implementations, the pocket retainer may be stitched, welded, bonded or otherwise affixed by vertical continuous or uninterrupted seems to either the waistband or portions of the panel forming an exterior of the upward waistband pocket such that one or both sides of the retention space are closed. In some implementations, all of the edge portions of the pocket retainer may be affixed by stitching, bonding or other methods to either the waistband or portions of the panel forming an exterior of the upward waistband pocket, wherein the pocket retainer comprises a slit through its outer face that forms or provides a mouth for insertion of articles into the retention space.

In some implementations, the pocket retainer may be affixed along multiple vertical seams to form a plurality of individual, separated retention spaces along an exterior of the waistband. In some implementations, the garment may comprise multiple individual pocket retainers which are affixed to either the waistband or portions of the panel forming an exterior of the upward waistband pocket so as to provide multiple individual, separated retention spaces about the waistband.

In some implementations, the pocket retainer is coupled to an exterior side of the waistband such that the retention space has closed opposite sides while being open along both its upper and lower edges. As result, articles may be inserted into and withdrawn from the retention space through either a top mouth or a bottom mouth. In some implementations, the pocket retainer is coupled to an exterior side of the waistband such that the retention space has closed opposite sides and has a closed bottom. In some implementations, the pocket retainer is coupled to the exterior side of the waistband such that the retention space has closed opposite sides and has a closed top, wherein articles are captured between the close top and the floor of the upward facing waist pocket. In some implementations, the pocket retainer is coupled to an exterior side of the waistband such that the retention space is closed along both its upper and lower edges, but is open on one or both of its lateral sides.

In some implementations, the pocket retainer comprises a panel affixed along at least two edge portions (top, bottom, left side, right side) to the exterior of the waistband by stitching. In some implementations, the panel forming the pocket retainer may be affixed to the exterior of the waistband by welding, adhesives or the like. In some implementations, the edge portions affixed to the exterior of the waistband are flat. In some implementations, the edge portions affixed to the exterior of the waistband are inwardly curled against the exterior of the waistband. In some implementations, the pocket retainer comprises a folded portion of the waistband. For example, the waistband may comprise a single panel or multiple panels. At least one of such panels forming the exterior the waistband may be folded outwardly and over to additionally form the pocket retainer.

In some implementations, the pocket retainer is coupled to an interior side of a front pocket panel that forms an exterior front of the upward facing waist pocket such that the retention space has closed opposite sides while being open along both its upper and lower edges. As result, articles may be inserted into and drawn from the retention space through either a top mouth or a bottom mouth. In some implementations, the pocket retainer is coupled to an interior side of a front pocket panel that forms an exterior front of the upward facing waist pocket such that the retention space has closed opposite sides and has a closed bottom. In some implementations, the pocket retainer is coupled to an interior side of a front pocket panel that forms an exterior front of the upward facing waist pocket such that the retention space has closed opposite sides and has a closed top, wherein articles are captured between the close top and the floor of the upward facing waist pocket. In some implementations, the pocket retainer is coupled to an interior side of a front pocket panel that forms an exterior front of the upward facing waist pocket such that the retention space is closed along both its upper and lower edges, but is open on one or both of its lateral sides.

In some implementations, the pocket retainer comprises a panel affixed along at least two edge portions (top, bottom, left side, right side) are coupled to an interior side of a front pocket panel that forms an exterior front of the upward facing waist pocket by stitching. In some implementations, the panel forming the pocket retainer is coupled to an interior side of a front panel that forms an exterior front of the upward facing waist pocket by welding, adhesives or the like. In some implementations, the edge portions coupled to an interior side of a front panel that forms an exterior front of the upward facing waist pocket are flat. In some implementations, the edge portions coupled to an interior side of a front panel that forms an exterior front of the upward facing waist pocket are inwardly curled against the exterior of the waistband. In some implementations, the pocket retainer comprises a folded portion of the front pocket panel that forms an exterior front of the upward facing waist pocket. For example, the upward facing waist pocket may be formed by an outer pocket panel. The outer pocket panel may have an inwardly folded top edge that forms a mouth or top opening of the upward facing waist pocket, wherein the inwardly folded portion of the outer pocket panel forms the pocket retainer.

For purposes of this disclosure, the term "coupled" shall mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate member being attached to one another. Such joining may be permanent in nature or alternatively may be removable or releasable in nature.

For purposes of this disclosure, the phrase "configured to" denotes an actual state of configuration that fundamentally ties the stated function/use to the physical characteristics of the feature proceeding the phrase "configured to".

For purposes of this disclosure, the term "releasably" or "removably" with respect to an attachment or coupling of two structures means that the two structures may be repeatedly connected and disconnected to and from one another without material damage to either of the two structures or their functioning.

For purposes of this disclosure, the term "inward" refers to a radial direction towards a vertical center of waistband 24, a direction towards either the coronal plane or the sagittal plane of the person wearing garment 20. The term "outward" refers to a radial direction outwards away from the vertical centerline of waistband 24. The term "inner" refers to a side facing the vertical centerline while the term "outer" refers to a side facing away from the vertical centerline. The term "upward" refers to a direction towards the head of the person wearing garment 20 while the term downward refers to a direction towards the feet of the person wearing garment 20.

For purposes of this disclosure, the term "panel" refers to one or more layers of material. The term "panel" may refer to a single layer of material or multiple overlapping layers of material. The layers of material may themselves by separate and distinct layers or panels that are laminated to one another, stitched to one another or welded to one another. The layers of material may be joined to one another along their edges or at selected locations. In some implementations, a panel may be folded to form multiple overlapping layers. In some implementations, the panel may be formed from a fabric. In some implementations, the panel may be formed from a polymer. In some implementations, the panel may be imperforate. In other implementations, the panel may be perforate or breathable. In some implementations, the panel may be in the form of a mesh or a netting. In some implementations, the panel may be formed from a flexible material. In some implementations, the panel may be formed from an elastic material. In some implementations, selected portions of the panel, such as edge portions of the panel, may be elastic. In some implementations, flexible edge portions of panel may be made elastic through the addition of an elastic band joined to the panel.

FIG. 1 illustrates portions of an example garment 20 for being worn about a waist of a person. Garment 20 comprises a piece of clothing or apparel such as a pair of shorts, a skirt, leggings, tights, a pair of pants or slacks, trousers, or other apparel worn about the waist of a person. As will be described hereafter, garment 20 facilitates more secure retention of articles, such as, for example, a cell phone, keys, snacks, etc., in one or more pockets extending along or at least partially about the waist of the person wearing garment 20. Garment 20 comprises a waistband 24, a lower extension 26, an upward facing waist pocket 30 and an internal pocket retainer, examples of which are shown in FIGS. 2-19.

Waistband 24 comprises one or more panels configured to extend about the waist of a person wearing garment 20 along or about the person's waistline. In some implementations, waistband 24 may be continuous or uninterrupted, lacking ends. In some implementations, waistband 24 may comprise opposite ends which are permanently joined to one another by stitching, bonding or the like. In implementations where waistband 24 is continuous, a person may step into waistband 24 when donning garment 20. In some implementations, waistband 24 may comprise end portions which are releasably connected to one another by a hook and loop fastener, buttons, clasps, hooks, or a buckle, permitting waistband 24 to be opened and wrapped about the waist of the person. In some implementations, waistband 24 may comprise end portions which are releasably connected to one another by one or more zippers. In some implementations, at least portions of waistband 24 may be elastic or resiliently stretchable. In some implementations, waistband 24 may be inelastic.

Lower extension 26 comprise one or more panels extending downwardly from a lower edge portion of waistband 24 and configured to cover at least upper portions of the groin and buttocks of the person wearing garment 20. In some implementations, lower extension 26 may extend further downward to also cover portions of the person's thighs or even greater portions of the person's legs. Lower extension 26 may have various configurations depending upon the type of garment 20. Lower extension 26 may itself comprise pockets. Lower extension 26 may include a front vertical opening that may be openable and closable with a zipper, buttons, snaps or the like. Lower extension 26 may be pleated. In some implementations, lower extension 26 may comprise a pair of leg portions in the form of sleeves for extending about or covering at least portions of the person's two legs.

The upward facing waist pocket 30 comprises a pocket coupled to waistband 24 along an exterior of waistband 24, wherein the pocket has a waist pocket interior having a floor, a rear wall, a front wall and a top mouth or top opening 32. Top opening 32 facilitates access to the interior of upward facing waist pocket 30 for the insertion of articles into the interior. In some implementations, top opening 32 may comprise a closure mechanism such as a zipper, and loop fastener or other mechanisms. In other implementations, top opening 32 may omit any closure mechanism.

In some implementations, upward facing waist pocket 30 continuously extends about the waist of the person wearing garment 20. In some implementations, upward facing waist pocket 30 comprises a single waist pocket having defined circumferential ends. In some implementations, upward facing waist pocket 30 is one of multiple waist pockets spaced about waistband 24.

Figure 2:
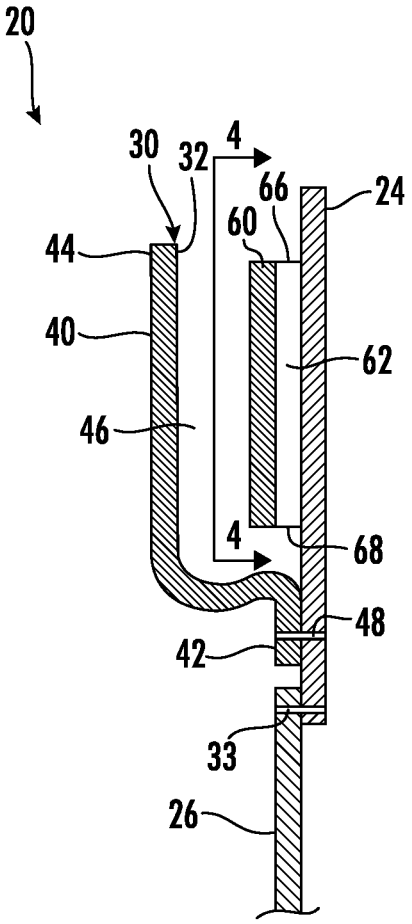
FIG. 2 is a sectional view of the garment of FIG. 1 taken along line 2-2.
Figure 3:
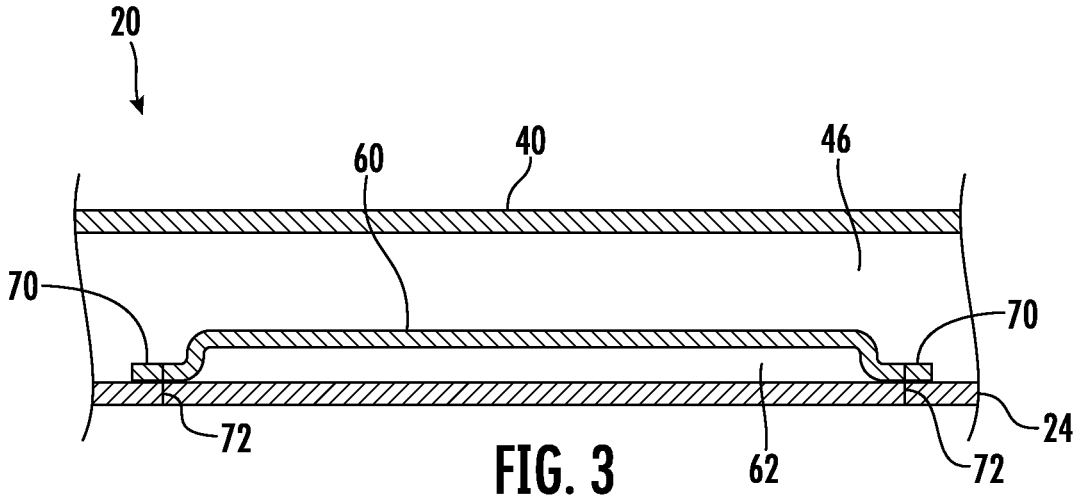
FIG. 3 is a top view of the garment of FIG. 1 taken along line 3-3.
Figure 4:
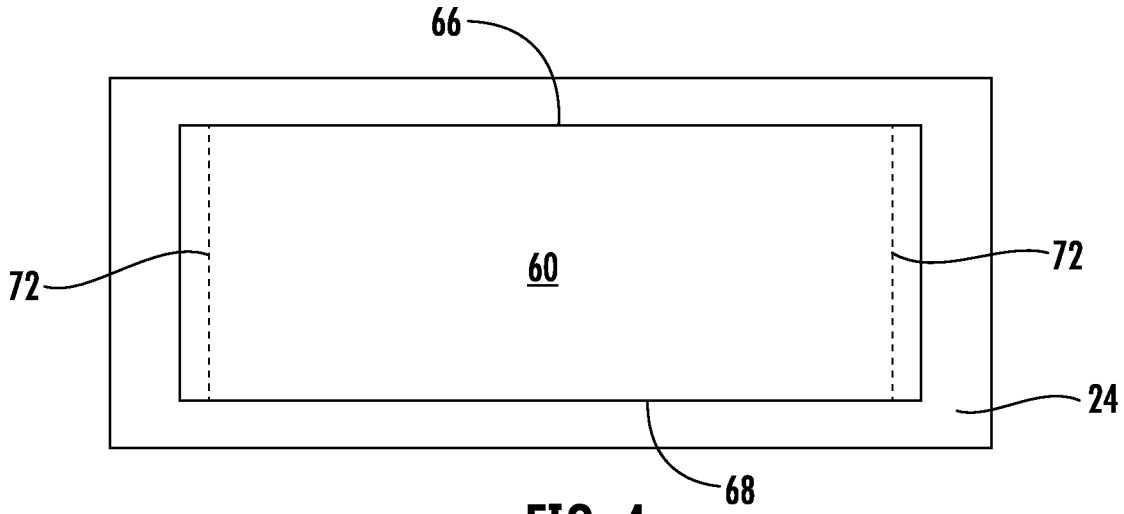
FIG. 4 is a side view of a portion of the garment of FIG. 2 taken along line 4-4.

FIGS. 2-4 illustrate one example of upward facing waist pocket 30 and an example internal pocket retainer 60 within the interior of waist pocket 30. As shown by FIG. 2, lower extension 26 extends downward from waistband 24 (schematically shown). Although waistband 24 is illustrated as comprising a single layer, waistband 24 may comprise multiple layers such as multiple layers of material joined to one another in an overlapping fashion or a panel that is folded to form two overlapping layers. In the example illustrated, lower extension 26 is joined to waistband 24 by stitching 33. In other implementations, lower extension 26 may be joined to waistband 24 by welds, adhesives or the like. In some implementations, lower extension 26 may be provided by a lower extending portion of one or more panels that also form waistband 24.

As further shown may FIG. 2, the example upward facing waist pocket 30 comprises a pocket panel 40 coupled at a lower edge portion 42 coupled to waistband 24 and having a free end portion 44 that forms top opening 32 of pocket 30. Pocket panel 40 and waistband 24 form an interior 46 of pocket 30.

In the example illustrated, lower edge portion 42 is flat and is joined to waistband 24 by stitching 48. In other implementations, lower edge portion 42 may be flat and joined to waistband 24 by adhesives, welding or other fastening techniques. Although pocket panel 40 illustrate as terminating above lower extension 26, in some implementations, pocket panel 40 may continuously extend downward, below waistband 24, to form portions of lower extension 26. In some implementations, rather than being flat, lower edge portion 42 may be inwardly turned or folded and joined to waistband 24. In some implementations, free end portion 44 may be curled or folded (inwardly or outwardly) and joined to itself to form a hem along top opening 32. Although pocket panel 40 is illustrated as comprising a single layer, in some implementations, pocket panel 40 may comprise multiple overlapping layers, whether being formed by multiple layers of material joined to one another or by a folded panel that provides multiple overlapping layers.

Pocket retainer 60 comprises a retention panel coupled to and directly supported by waistband 24, along the exterior waistband 24 within interior 46 of upward facing waist pocket 30. Pocket retainer 60 forms a retention space 62 between pocket retainer 60 and waistband 24. Retention space 62 is closed on both opposite ends, yet is open along both its top edge and its bottom edge, forming a top mouth 66 and a bottom mouth 68 through which articles may be into and withdrawn from retention space 62. In the example illustrated, opposite side edge portions 70 of pocket retainer 60 are joined to waistband 24 along vertical seams or lines 72. In the example, line 72 are formed by stitching. In other implementations, edge portions 70 may be directly coupled to waistband 24 or indirectly coupled to waistband 24 along lines 72 in other fashions, such as with adhesives, welds or the like.

In some implementations, pocket retainer 60 and retention space 62 extend along a front of waistband 24, above that portion of lower extension 26 which covers a groin of the person wearing garment 20. In some implementations, pocket retainer 60 and retention space 62 extend along a rear of waistband 24, above that portion of lower extension 26 which covers buttocks of the person wearing garment 20.

In some implementations, pocket retainer 60 is entirely formed from an elastic panel of material. In some implementations, top and bottom edge portions of pocket retainer 60 are elastic. In some implementations, top and bottom edge portions of pocket retainer 60 are made elastic through the addition of an elastic band long such opposite edges and secured to the panel forming pocket retainer 60. In some implementations, the panel forming pocket retainer 60 is formed from a fabric material. In some implementations, the panel forming pocket retainer 60 is formed from a polymer. In some implementations, the panel forming pocket retainer 60 comprises a mesh or netting. The mesh or netting may itself be elastic or resiliently stretchable, or may include edges that are elastic or resiliently stretchable.

FIGS. 2 and 3 illustrate panel 40 and internal pocket retainer 60 being flexed or temporarily deformed away from waistband 24 for the insertion of articles into pocket 30 and retention space 62. In some implementations, panel 40 and pocket retainer 60 may be inelastic and dimensioned so as to extend flat against waistband 24 when worn about the waist. In some implementations, panel 40 and/or pocket retainer 60 may be configured to extend flat against waistband 24 in the absence of articles within pocket 30 or retention space 62. In some implementations, panel 40 and/or pocket retainer 60 may alternatively have a default, unstretched shape or condition spaced from waistband 24 as shown in FIGS. 2 and 3.

Figure 5:
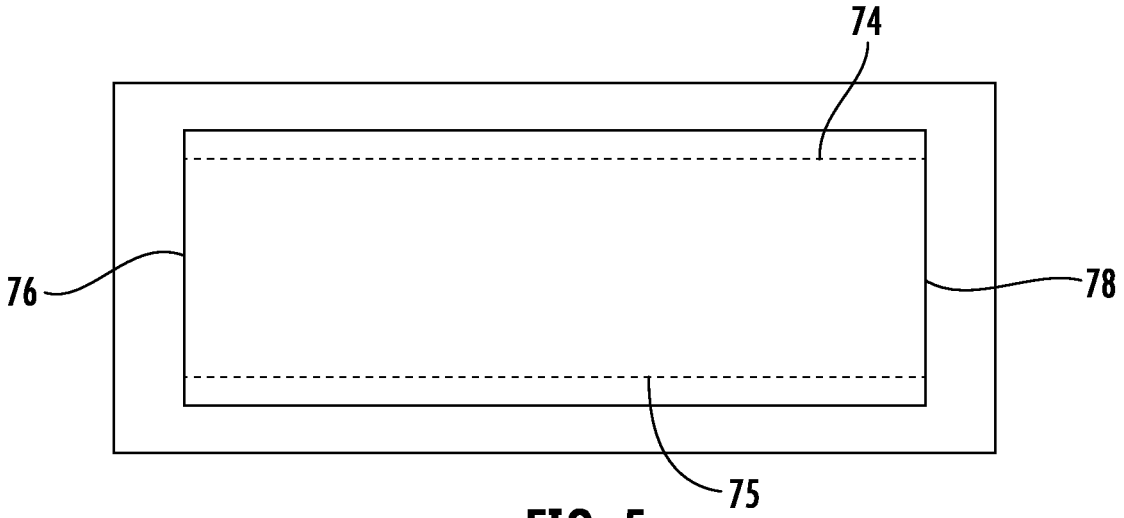
FIG. 5 is a side view of a portion of another example garment, similar to the garment of FIG. 2, taken along line 4-4.

As shown by FIG. 5, in some implementations, retention space 62 may have open sides, but a closed interior top and bottom. As shown by FIG. 5, pocket retainer 60 may be joined to or affixed to waistband 24 along horizontal lines 74, 75 such that the retention space 62 may be accessed through side mouths 76 which open or face in sideways directions. Horizontal lines 74 and 75 may be formed by stitching, welds, adhesive lines and the like.

Figure 6:
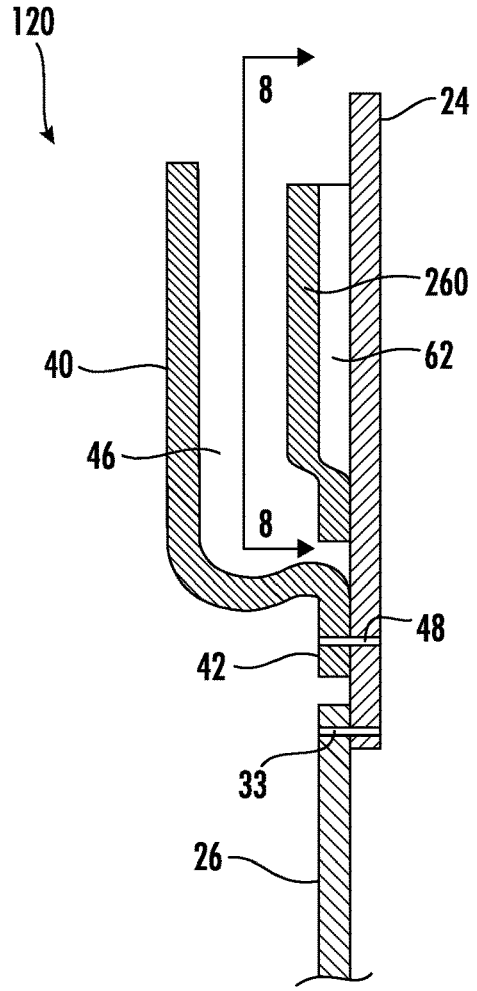
FIG. 6 is a sectional view of an example garment taken along line 2-2 of FIG. 1.
Figure 7:
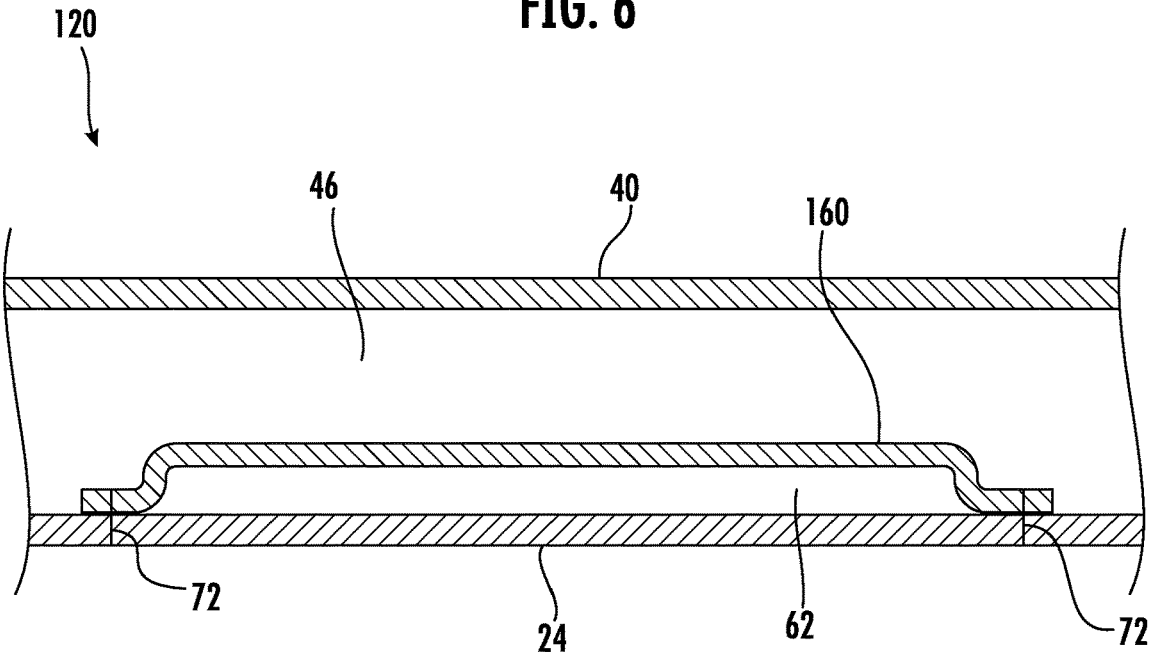
FIG. 7 is a top view of the garment of FIG. 6 taken along line 3-3 of FIG. 1.
Figure 8:
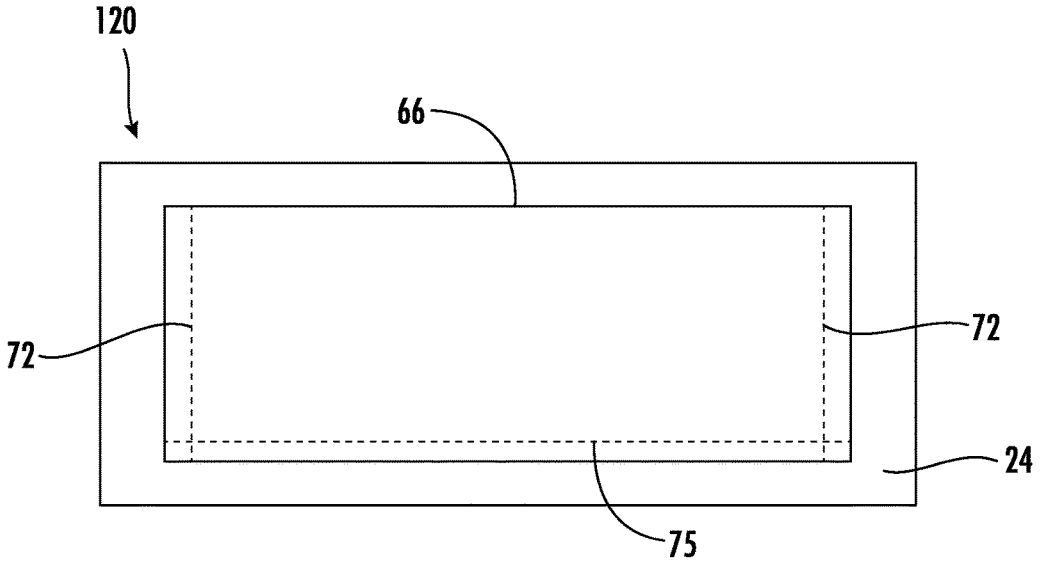
FIG. 8 is a side view of a portion of the garment of FIG. 6 taken along line 8-8.

FIGS. 6-8 illustrate portions of an example garment 120. Garment 120 is similar to garment 20 described above except that garment 120 comprises the example upward facing waist pocket 30 containing an example internal pocket retainer 160. FIGS. 6-8 illustrate an example of how the pocket retainer may be secured to waistband to provide the retention space with a floor. Pocket retainer 160 is similar to pocket retainer 60 except pocket retainer 160 is additionally secured or joined to waistband 24 along a lower horizontal line 75 to form a bottom or floor for interior space 62. Horizontal line 75 may be provided by stitching, welds, adhesives or the like. Those components of garment 120 which correspond to components of garment 20 of FIGS. 1-4 are numbered similarly and/or are shown in FIGS. 1-4.

In some implementations, pocket retainer 160 and retention space 62 extend along a front of waistband 24, above that portion of lower extension 26 which covers a growing of the person wearing garment 20. In some implementations, pocket retainer 160 and retention space 62 extend along a rear of waistband 24, above that portion of lower extension 26 which covers a buttocks of the person wearing garment 20. In some implementations, pocket retainer 160 continuously extends about waistband 24. In some implementations, garment 120 comprises multiple circumferentially spaced pocket retainers. In some implementations, pocket retainer 160 may comprise a plurality of vertically spaced bands or are vertically spaced panels.

Figure 9:
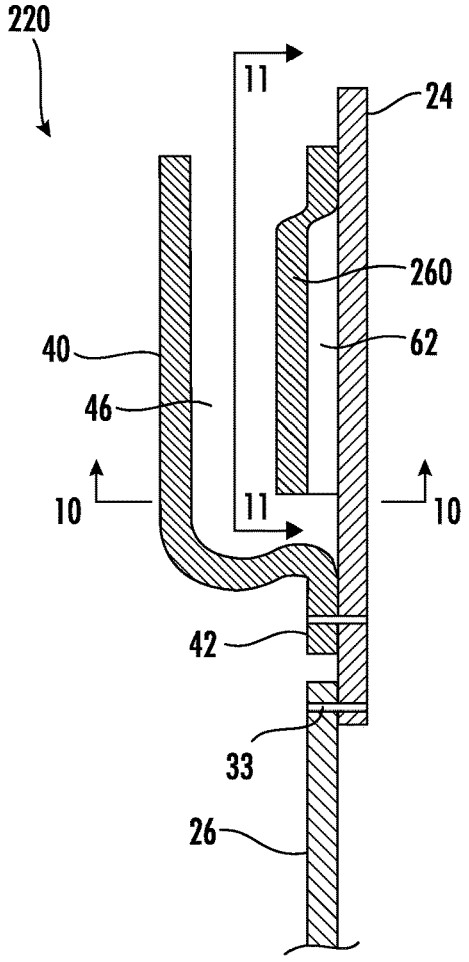
FIG. 9 is a sectional view of an example garment taken along line 2-2 of FIG. 1.
Figure 10:
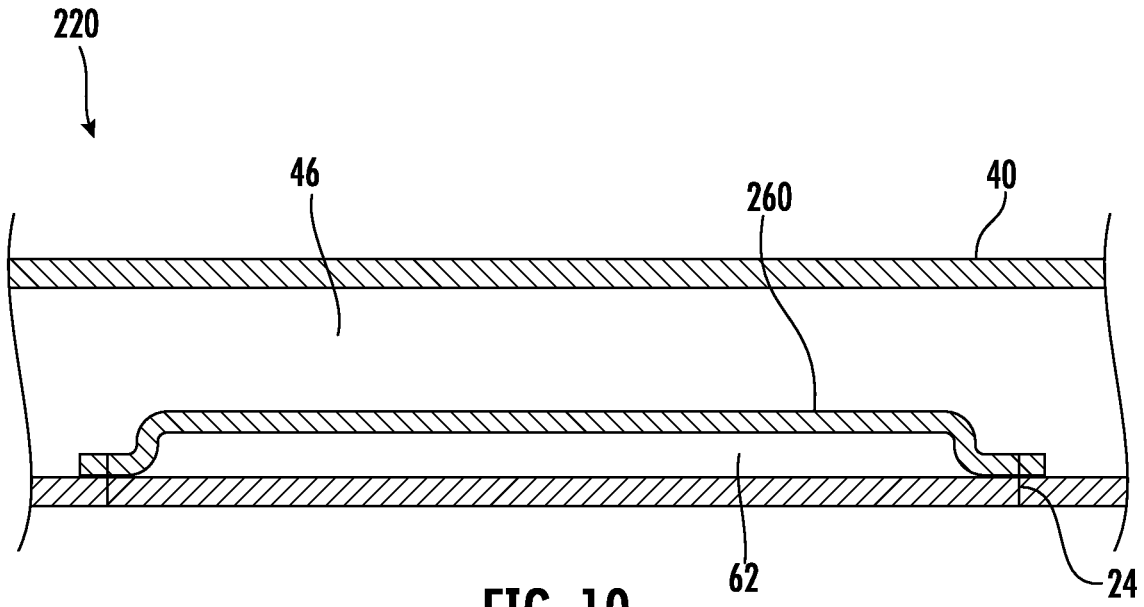
FIG. 10 is a bottom view of a portion of the garment of FIG. 9 taken along line 10-10.
Figure 11:
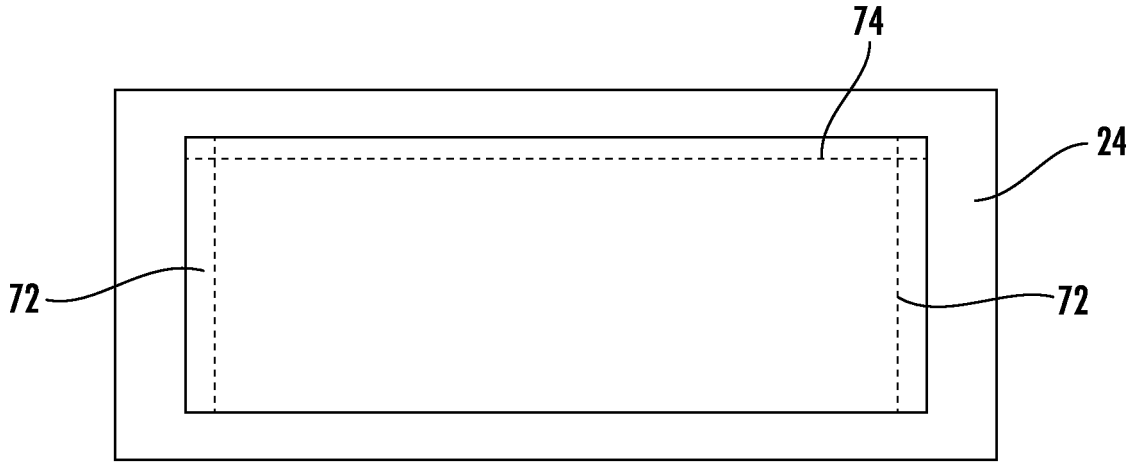
FIG. 11 is a side view of a portion of the garment of FIG. 9 taken along line 11-11.

FIGS. 9-11 illustrate portions of an example garment 220. Garment 220 is similar to garment 20 described above except that garment 220 comprises the example upward facing waist pocket 30 containing an example internal pocket retainer 260. FIGS. 9-11 illustrate an example of how the pocket retainer may be secured to waistband to provide the retention space with a closed top so as to capture articles between the closed top and the floor of pocket 30. Pocket retainer 260 is similar to pocket retainer 60 except pocket retainer 260 is additionally secured or joined to waistband 24 along an upper horizontal line 74 to form a ceiling or closed top for interior space 62. Horizontal line 74 may be provided by stitching, welds, adhesives or the like. Those components of garment 220 which correspond to components of garment 20 are numbered similarly and/or are shown in FIGS. 1-4.

In some implementations, pocket retainer 260 and retention space 62 extend along a front of waistband 24, above that portion of lower extension 26 which covers a growing of the person wearing garment 20. In some implementations, pocket retainer 260 and retention space 62 extend along a rear of waistband 24, above that portion of lower extension 26 which covers a buttocks of the person wearing garment 20. In some implementations, pocket retainer 260 continuously extends about waistband 24. In some implementations, garment 220 comprises multiple circumferentially spaced pocket retainers. In some implementations, pocket retainer 260 may comprise a plurality of vertically spaced bands or are vertically spaced panels.

Figure 12:
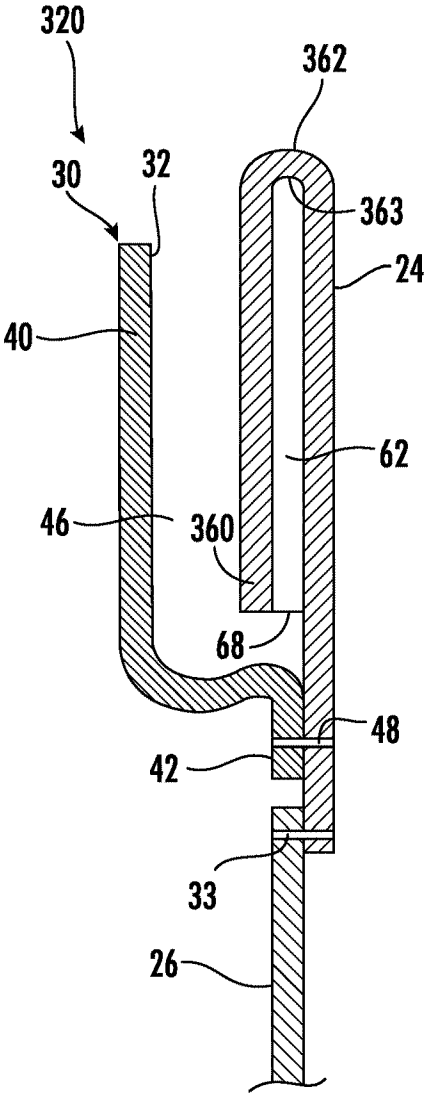
FIG. 12 is a sectional view of a portion of an example garment taken along line 2-2 of FIG. 1.

FIG. 12 is a sectional view illustrating portions of an example garment 320. FIG. 12 illustrates an example of how a portion of the waistband may be folded outwardly to form a pocket retainer. Garment 320 is similar to garment 220 described above except that garment 320 comprises pocket retainer 360. Those remaining components of garment 320 which correspond to components of garments 20 and 220 are numbered similarly and/or are shown above.

Pocket retainer 360 portion is formed from an outwardly folded portion of a panel of waistband 24. The panel of waistband 24 that is folded outwardly forms a top folded edge 362 extending along the perimeter of top opening 32. Pocket retainer 360 extends downwardly from the upper folded edge 362 towards the floor or bottom of interior 46 of pocket 30, forming retention space 62 having a closed top 363 and an open bottom 68. As shown by FIG. 11, in some implementations, retention space 62 has closed sides, closed at lines 72 (shown in FIG. 4). In other implementations, one or both of lines 72 may be omitted, wherein retention space 62 continuously extends around waistband 24 without interruption or continuously extends from one side of a single line 72 to the other side of a single line 72

In some implementations, pocket retainer 360 and retention space 62 extend along a front of waistband 24, above that portion of lower extension 26 which covers a groin of the person wearing garment 20. In some implementations, pocket retainer 360 and retention space 62 extend along a rear of waistband 24, above that portion of lower extension 26 which covers a buttocks of the person wearing garment 20. In some implementations, pocket retainer 360 continuously extends about waistband 24 extending around the entire waistband (extending 360 degrees). In some implementations, garment 320 comprises multiple circumferentially spaced pocket retainers. In some implementations, pocket retainer 360 may comprise a plurality of vertically spaced bands and/or vertically spaced panels.

Because pocket retainer 360 is formed as part of a panel forming at least a part of waistband 24, garment 320 and pocket retainer 360 may be less complicated and less costly to manufacture. Moreover, pocket retainer 360 may be more robust.

Figure 14:
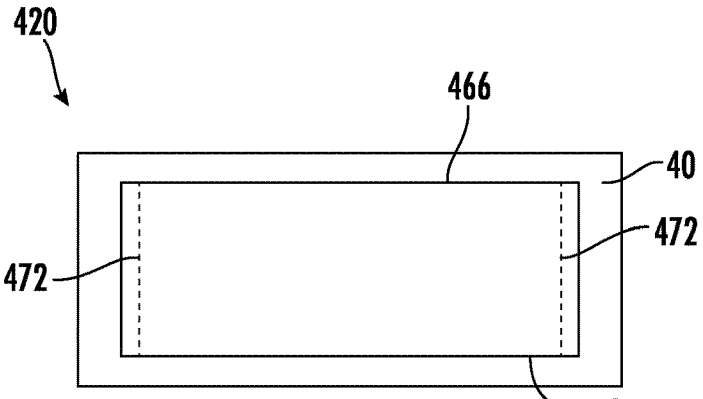
FIG. 14 is a side view of a portion of the garment of FIG. 13 taken along line 14-14.
Figure 13:
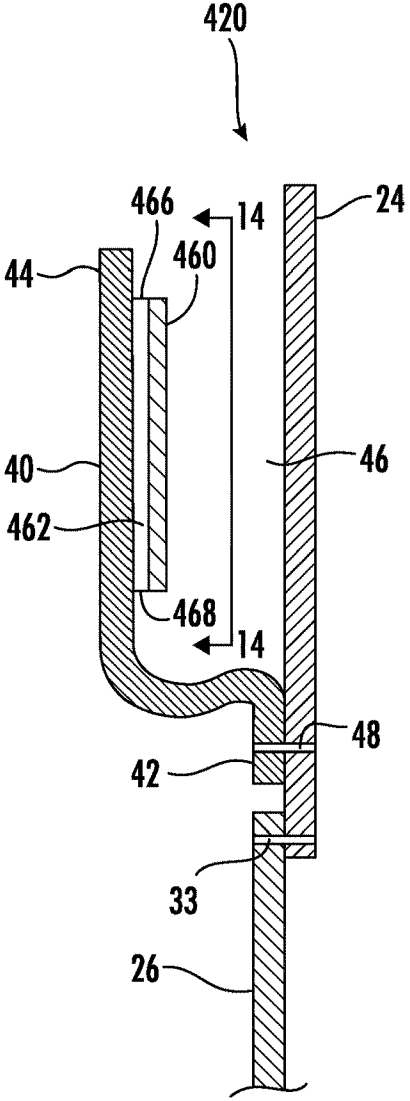
FIG. 13 is a sectional view of a portion of an example garment taken along line 2-2 of FIG. 1.

FIGS. 13-19 illustrate example garments wherein a pocket retainer is coupled to and supported by pocket panel 40 within interior 46 of pocket 30. FIGS. 13 and 14 illustrate portions of an example garment 420. Garment 420 is similar to garment 20 described above except that garment 420 comprises pocket retainer 460 in place of pocket retainer 60. Those remaining components of garment 420 which correspond to components of garment 20 are numbered similarly and such or are shown and described above with respect to FIGS. 1-4.

Pocket retainer 460 comprises a retention panel coupled to and directly supported by pocket panel 40, along the inner side of pocket panel 40 within interior 46 of upward facing waist pocket 30. Pocket retainer 460 forms a retention space 462 between pocket retainer 60 and pocket panel 40. Retention space 462 is closed on both opposite ends yet is open along both its top edge and its bottom edge, forming a top mouth 466 and a bottom mouth 468 through which articles may be inserted into and withdrawn from retention space 462.

As shown by FIG. 14, in the example illustrated, opposite side edge portions of pocket retainer 460 are joined to pocket panel 40 along horizontally spaced vertical seams or lines 472. In the example illustrated, lines 472 are formed by stitching. In other implementations, side edge portions of retainer 460 may be directly coupled to pocket panel 40 or indirectly coupled to pocket panel 40 along such horizontally spaced vertical lines in other fashions, such as with adhesives, welds or the like.

Figure 15:
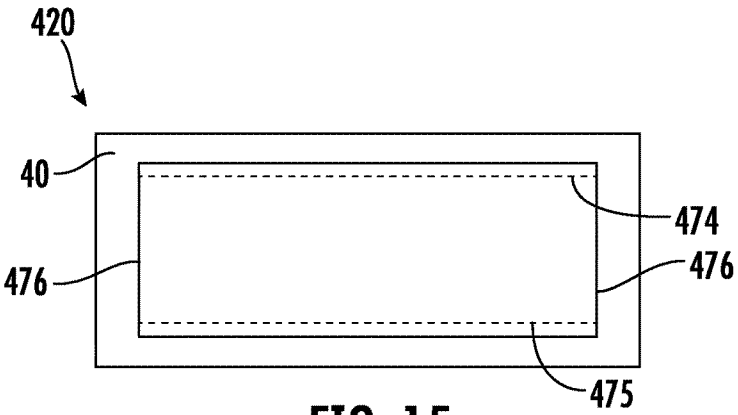
FIG. 15 is a side view of a portion of an example garment similar to the garment of FIG. 14 taken along line 14-14.

As shown by FIG. 15, in some implementations, retention space 462 may have open sides, but a closed interior top and bottom. As shown by FIG. 15, pocket retainer 460 may be joined to or affixed to pocket panel 40 along horizontal lines 474, 475 such that the retention space 62 may be accessed through side mouths 476 which open or face in sideways directions. Horizontal lines 474 and 475 may be formed by stitching, welds, adhesive lines and the like.

In some implementations, pocket retainer 460 and retention space 462 extend along a front of waistband 24, above that portion of lower extension 26 which covers a groin of the person wearing garment 420. In some implementations, pocket retainer 460 and retention space 462 extend along a rear of waistband 24, above that portion of lower extension 26 which covers a buttocks of the person wearing garment 420. In some implementations, pocket retainer 460 continuously extends about waistband 24. In some implementations, garment 420 comprises multiple circumferentially spaced pocket retainers. In some implementations, pocket retainer 460 may comprise a plurality of vertically spaced bands and/or vertically spaced panels.

Figure 16:
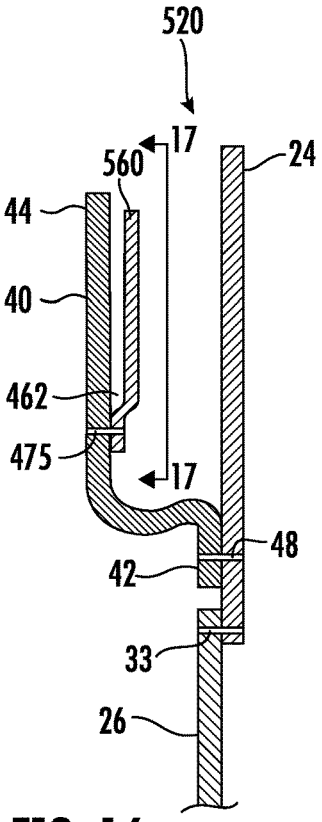
FIG. 16 is a sectional view of a portion of an example garment taken along line 2-2 of FIG. 1.
Figure 17:
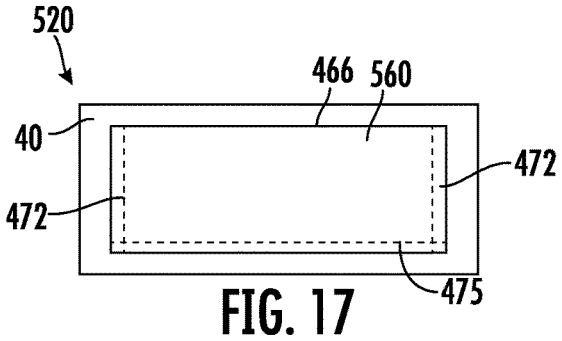
FIG. 17 is a side view of a portion of the garment of FIG. 16 taken along line 17-17.

FIGS. 16 and 17 illustrate portions of an example garment 520. Garment 520 is similar to garment 20 described above except that garment 520 comprises pocket retainer 560 in place of pocket retainer 60. Those remaining components of garment 520 which correspond to components of garment 20 are numbered similarly and such or are shown and described above with respect to FIGS. 1-4.

Garment 520 is similar to garment 420 described above except that garment 520 comprises with the example upward facing waist pocket 30 containing an example internal pocket retainer 560. FIGS. 16 and 17 illustrate an example of how the pocket retainer may be secured to waistband to provide the retention space with a floor. Pocket retainer 560 is similar to pocket retainer 460 except pocket retainer 560 is additionally secured or joined to pocket panel 40 along a lower horizontal line 475 to form a bottom or floor for interior space 462. Horizontal line 475 may be provided by stitching, welds, adhesives or the like. Those components of garment 520 which correspond to components of garment 420 are numbered similarly and/or are shown in FIGS. 1-4 and 13.

In some implementations, pocket retainer 560 and retention space 462 extend along a front of waistband 24, above that portion of lower extension 26 which covers a groin of the person wearing garment 520. In some implementations, pocket retainer 560 and retention space 462 extend along a rear of waistband 24, above that portion of lower extension 26 which covers a buttocks of the person wearing garment 520. In some implementations, pocket retainer 560 continuously extends about waistband 24. In some implementations, garment 520 comprises multiple circumferentially spaced pocket retainers. In some implementations, pocket retainer 560 may comprise a plurality of vertically spaced bands or are vertically spaced panels.

Figure 18:
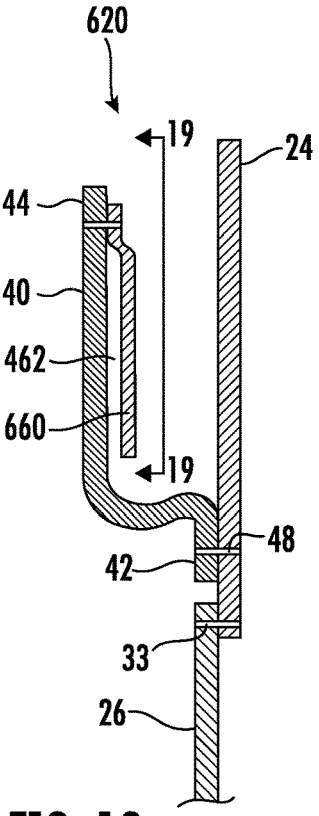
FIG. 18 is a sectional view of a portion of an example garment taken along line 2-2 of FIG. 1.
Figure 19:
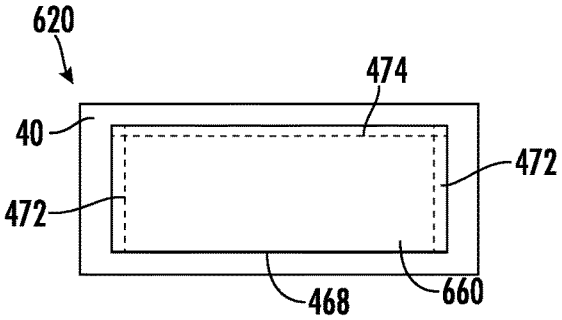
FIG. 19 is a side view of a portion of the garment of FIG. 16 taken along line 19-19.

FIGS. 18 and 19 illustrate portions of an example garment 620. Garment 620 is similar to garment 420 described above except that garment 620 comprises the example upward facing waist pocket 30 containing an example internal pocket retainer 660. FIGS. 18 and 19 illustrate an example of how the pocket retainer may be secured to pocket panel 40 to provide the retention space 462 with a closed top so as to capture articles between the closed top and the floor of pocket 30. Pocket retainer 660 is similar to pocket retainer 460 except pocket retainer 660 is additionally secured or joined to pocket panel 40 along an upper horizontal line 474 to form a ceiling or closed top for interior space 462. Horizontal line 474 may be provided by stitching, welds, adhesives or the like. Those components of garment 620 which correspond to components of garment 420 are numbered similarly and/or are shown in FIGS. 1-4 and 13.

In some implementations, pocket retainer 660 and retention space 462 extend along a front of waistband 24, above that portion of lower extension 26 which covers a groin of the person wearing garment 620. In some implementations, pocket retainer 660 and retention space 462 extend along a rear of waistband 24, above that portion of lower extension 26 which covers a buttocks of the person wearing garment 620. In some implementations, pocket retainer 660 continuously extends about waistband 24. In some implementations, garment 620 comprises multiple circumferentially spaced pocket retainers. In some implementations, pocket retainer 660 may comprise a plurality of vertically spaced bands or are vertically spaced panels.

Figure 20:
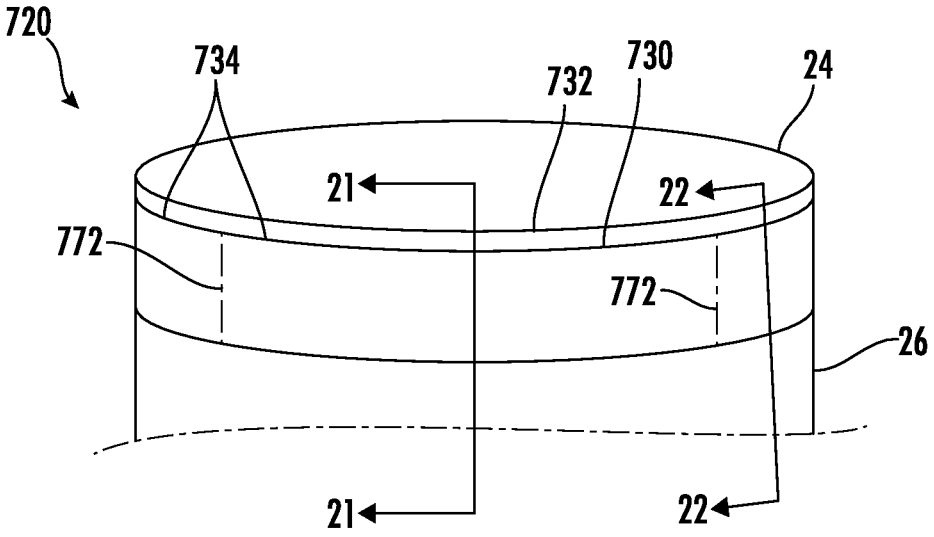
FIG. 20 perspective view illustrating portions of an example garment.
Figure 21:
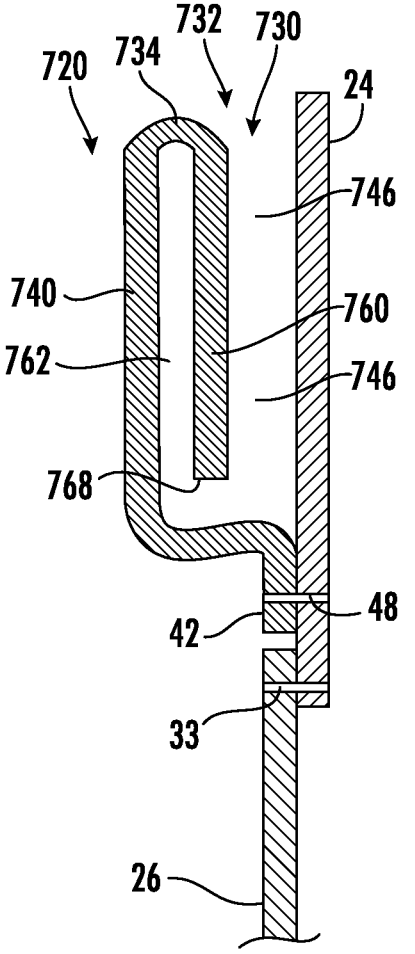
FIG. 21 is a sectional view of the garment of FIG. 20 taken along line 21-21.
Figure 22:
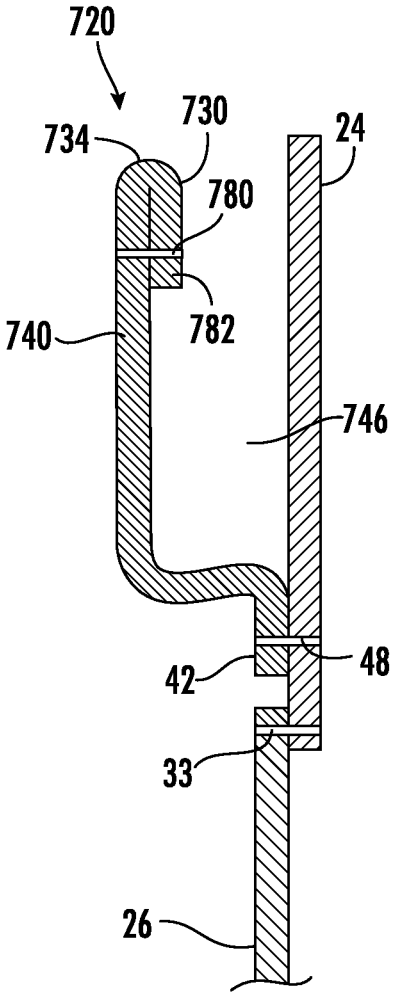
FIG. 22 is a sectional view of the garment of FIG. 20 taken along line 22-22.

FIGS. 20, 21 and 22 illustrate portions of an example garment 720. Garment 720 is similar to garment 20 described above except that garment 720 comprises a pocket panel 740 that is inwardly folded along its top edge to form upward facing waist pocket 730 and pocket retainer 760. Those remaining components of garment 720 which correspond to components of garment 20 are numbered similarly and/or are shown in FIGS. 1-4.

As with pocket panel 40, pocket panel 740 has a lower portion 42 joined to waistband 24 so as to form a floor of upward facing waist pocket 730. Upward facing waist pocket 730 further comprises an interior 746 and a mouth or top opening 732 defined by waistband 24 and a top folded edge portion 734 of pocket panel 740.

Pocket retainer 760 comprises that portion of pocket panel 740 extending downwardly from top folded edge portion 34 into and within interior 746. Pocket retainer 760 forms a retention space 762 bordered on opposite faces or sides by pocket retainer 760 and an inner side of pocket panel 740. Retention space 762 has a lower downward facing mouth 768 through which article may be positioned within retention space 762. Retention space 768 has a ceiling or a top provided by top folded edge 734. As result, articles positioned within retention space 762 are vertically captured and retained within retention space 762 by the mutually facing portions of top folded edge 734 and the floor of waist pocket 730. Said another way, articles within retention space 762 cannot vertically rise and exit retention space 762.

As shown by FIG. 20, in some implementations, retention space 762 may have closed lateral sides, being close along vertical lines 772. Vertical line 772 comprise portions where pocket retainer 760 is affixed or joined to the outermost portion of pocket panel 740. In some implementations, pocket retainer 760 may be additionally affixed or joined to waistband 24 along line 772. In some implementations, lines 772 are formed by stitching. In other implementations, lines 772 are formed by adhesives, welding or the like. In some implementations, one or both of line 772 may be omitted, wherein retention space 762 continuously extends 360° about waistband 24, either without interruption (no lines 772) or from one side of a single line 772 to another side of same single line 772. In implementations where one or both lines 772 are omitted, the retention space can extend around the waistband 24, up to 360 degrees about the waistband 24.

In some implementations, pocket retainer 760 and retention space 762 extend along a front of waistband 24, above that portion of lower extension 26 which covers a groin of the person wearing garment 20. In some implementations, pocket retainer 760 and retention space 762 extend along a rear of waistband 24, above that portion of lower extension 26 which covers a buttocks of the person wearing garment 20. In some implementations, pocket retainer 760 continuously extends about waistband 24. In some implementations, garment 720 comprises multiple circumferentially spaced pocket retainers. In some implementations, pocket retainer 760 may comprise additional retention bands vertically below pocket retainer 760.

Because pocket retainer 760 is formed as part of pocket panel 740, garment 720 and pocket retainer 760 may be less complicated and less costly to manufacture. Moreover, pocket retainer 760 may be more robust.

As shown by FIGS. 20 and 22, in the example illustrated, selected portions about waistband 24 may include upward facing waist pocket 730, but omit pocket retainer 760. For example, in those portions outside of line 772, the inwardly folded portion of pocket panel 740 may be joined to itself along a horizontal line 780 so as to form a hem 782 along top opening 732. In such implementations, interior 746 may be larger, wider as seen in FIG. 22. In some implementations, line 780 may be formed by stitching. In some implementation line 780 may be formed by welding, adhesives and the like.

Figure 23:
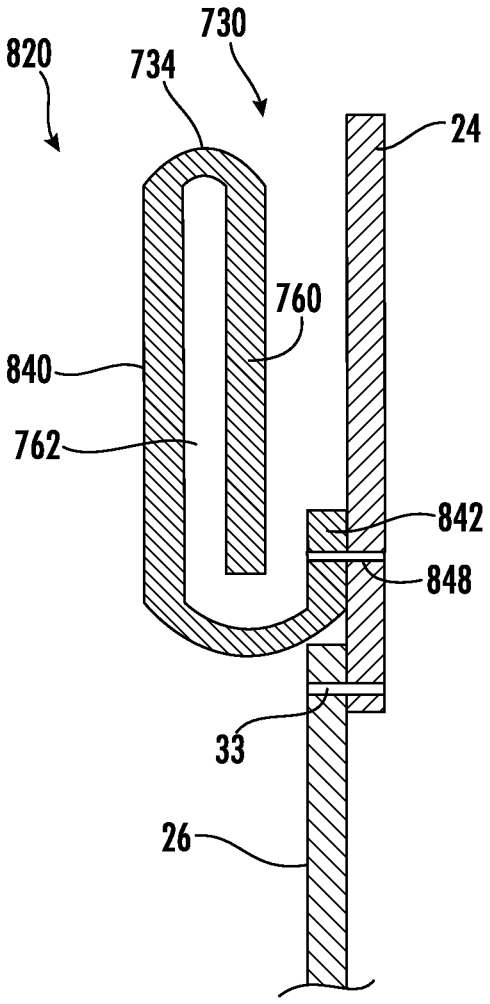
FIG. 23 is a sectional view of an example garment taken along line 21-21 of FIG. 20.

FIG. 23 is a sectional view illustrating portions of an example garment 820. FIG. 23 illustrates an example of how a pocket panel may alternatively be coupled to waistband 24. Garment 820 comprises pocket panel 840 in place of pocket panel 740. Those components of garment 820 which correspond to components of garment 720 are numbered similarly and/or are shown in FIGS. 20-22.

Pocket panel 840 is similar to pocket panel 740 described above except that lower edge portion 842 of pocket panel 840 is upwardly folded or curled against waistband 24 and is secured to waistband 24 by stitching 848. In other implementations, lower edge portion 842 may be secured to waistband 24 by adhesives, welding or other fastening techniques. Because lower edge portion 842 curls upwardly, rather than downwardly, against waistband 24, the floor of the waistband pocket 730 may be more robust.

Figure 24:
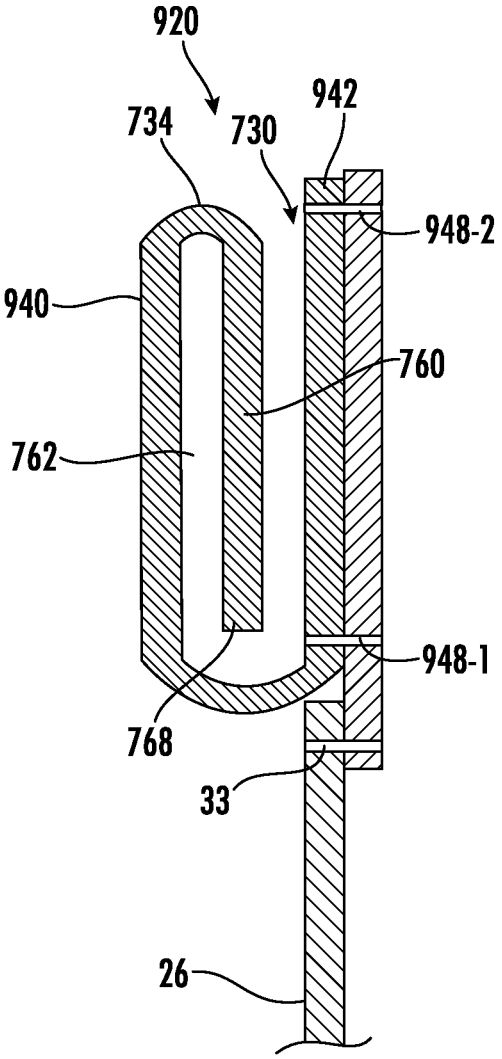
FIG. 24 is a sectional view of an example garment taken along line 21-21 of FIG. 20.

FIG. 24 is a sectional view illustrating portions of an example garment 920. FIG. 24 illustrates an example of how a pocket panel may alternatively be coupled to waistband 24. Garment 920 comprises pocket panel 940 in place of pocket panel 840. Those components of garment 920 which correspond to components of garment 820 are numbered similarly and/or are shown in FIGS. 20-23.

Pocket panel 940 is similar to pocket panel 840 described above except that lower edge portion 942 of pocket panel 940 is much longer than lower edge portion 842 so as to overlap and extend in front of at least a majority of waistband 24. In the example illustrated, lower edge portion 942 covers substantially all of waistband 24 opposite to upward facing waist pocket 730. As result, the interior 746 of pocket 730 has a uniform interior appearance, the entire interior of pocket 730 being formed from the same material of panel 940. In addition, because the juncture of lower edge portion 942 and waistband 24 is at or above folded edge portion 734, the lower edge portion 942 is distanced from the floor of pocket 730, making pocket 730 more robust and less likely to separate from waistband 24.

In the example illustrated, lower edge portion 942, is joined to waistband 24 along to stitching lines 948-1 and 948-2 (collectively referred to as lines 948). In other implementations, lower edge portion 842 may be secured to waistband 24 by adhesives, welding or other fastening techniques. In some implementations, rather than being secured to waistband 24 by stitching lines 948, larger surface area provided by the longer lower edge portion 942 may be better laminated, welded, fused or adhered to waistband 24.

Figure 27:
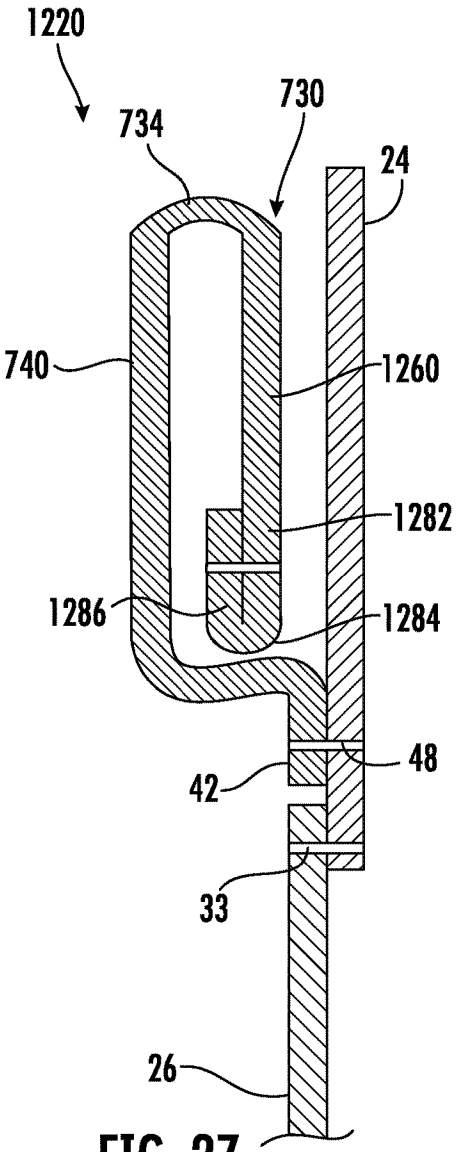
FIG. 27 is a sectional view of an example garment taken along line 21-21 of FIG. 20.
Figure 26:
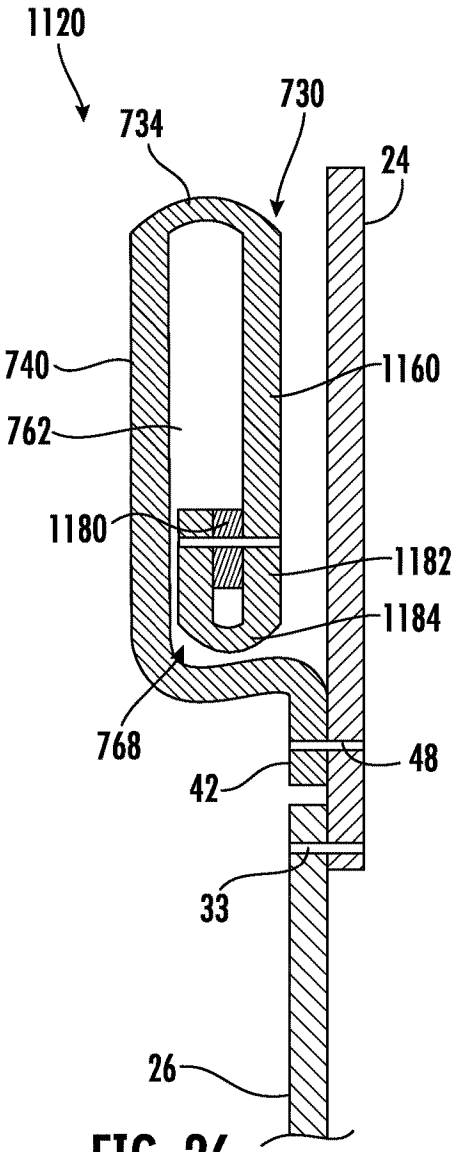
FIG. 26 is a sectional view of an example garment taken along line 21-21 of FIG. 20.
Figure 25:
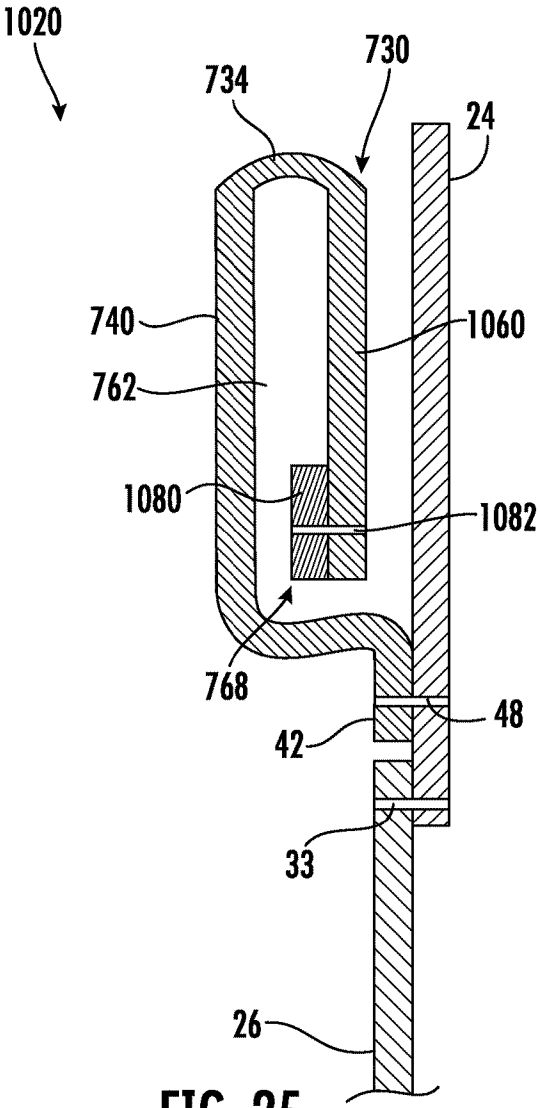
FIG. 25 is a sectional view of an example garment taken along line 21-21 of FIG. 20.

FIGS. 25-27 are sectional views illustrating examples of different configurations for the pocket retainer extending downwardly into the upward facing waist pocket from the folded edge portion of the pocket panel. FIG. 25 illustrates portions of an example garment 1020 having pocket retainer 1060 in place of pocket retainer 760. Those remaining components of garment 1020 which correspond to components of garment 720 are numbered similarly and/or are shown in FIGS. 20-22.

Pocket retainer 1060 is similar to pocket retainer 760 except that the lower end of pocket retainer 1060 is secured to an additional band 1080 by stitching 1082. Band 1080 extends along a lower edge or tip of retainer 1060 along the upwardly facing mouth 768 of retention space 762. In lieu of being joined to retainer 1060 by stitching 1082, band 1080 may alternatively be welded, laminated, bonded or otherwise joined to pocket retainer 1060.

Band 1080 extends between retainer 1060 and the front of pocket panel 740 so as to narrow or reduce the size of mouth 768. As result, band 1080 may assist in retaining articles within retention space 762. In some implementations, retainer 1060 is flexible, but inelastic, wherein band 1080 is elastic so as to resiliently close mouth 768. In some implementations, retainer 1060 is flexible, but inelastic, wherein band 1080 is also inelastic, but wherein band 1080 has a greater degree of stiffness as compared to retainer 1060 so as to rigidify mouth 768. In some implementations, both retainer 1060 and band 1080 are elastic.

FIG. 26 illustrates portions of an example garment 1120 having pocket retainer 1160 in place of pocket retainer 760. Those remaining components of garment 1120 which correspond to components of garment 720 are numbered similarly and/or are shown in FIGS. 20-22.

Pocket retainer 1160 is similar to pocket retainer 760 except that the lower end of pocket retainer 1160 is outwardly folded or curled about an additional band 1180 by stitching 1182. Band 1180 extends along a lower edge or tip of retainer 1060 along the upwardly facing mouth 768 of retention space 762. In lieu of being joined to retainer 1160 by stitching 1082, band 1180 may alternatively be welded, laminated, bonded or otherwise joined to pocket retainer 1160 within the lower folded edge portion 1184 of retainer 1160.

The lower folded edge portion 1184 provides a more robust lower edge for retainer 1160 and protects band 1180. Lower folded edge portion 1184 and band 1080 extend between the unfolded portion of retainer 1160 and the front of pocket panel 740 so as to narrow or reduce the size of mouth 768. As result, lower folded edge portion 1184 and band 1180 may assist in retaining articles within retention space 762. In some implementations, retainer 1160 is flexible, but inelastic, wherein band 1180 is elastic so as to resiliently close mouth 768. In some implementations, retainer 1160 is flexible, but inelastic, wherein band 1180 is also inelastic, but wherein band 1180 has a greater degree of stiffness as compared to retainer 1160 so as to rigidify mouth 768. In some implementations, both retainer 1160 and band 1180 are elastic.

FIG. 27 illustrates portions of an example garment 1220 having pocket retainer 1260 in place of pocket retainer 760. Those remaining components of garment 1220 which correspond to components of garment 720 are numbered similarly and/or are shown in FIGS. 20-22.

Pocket retainer 1260 is similar to pocket retainer 760 except that the lower end of pocket retainer 1160 is outwardly folded or curled end secured to itself by stitching 1282 to form a lower hem 1286. In lieu of being joined to itself by stitching 1282, hem 1286 may alternatively be welded, laminated, bonded or otherwise joined to pocket retainer 1260 to form the lower folded edge portion 1284 of retainer 1260. The lower folded edge portion 1284 provides a more robust lower edge for retainer 1260.

Garments 1020, 1120 and 1220 in FIGS. 25-27 are each illustrated as having pocket panel 740 secured to waistband 24 in the same fashion as garment 720. In particular, each of such garments is illustrated as having a lower end portion 42 extending downwardly and flat against waistband 24 while being secured to waistband 24 by stitching 48. In other implementations, each of such garments may alternatively have the pocket panel joined to waistband 24 in a fashion similar to that shown in FIGS. 23 and 24, wherein the lower edge portion of the pocket panels upwardly folded or curled and secured along waistband 24.

Figure 30:
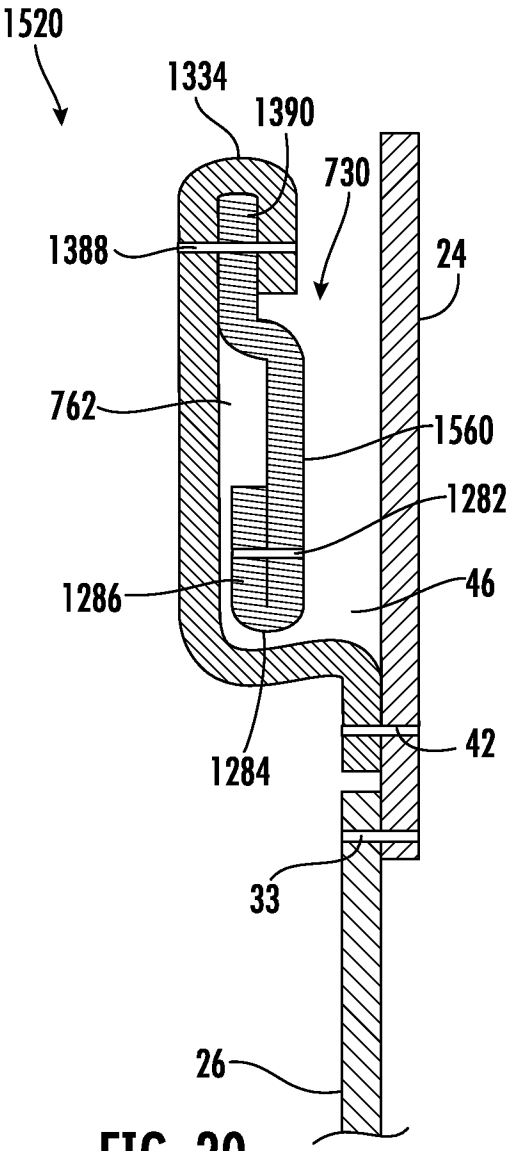
FIG. 30 is a sectional view of an example garment taken along line 21-21 of FIG. 20.
Figure 29:
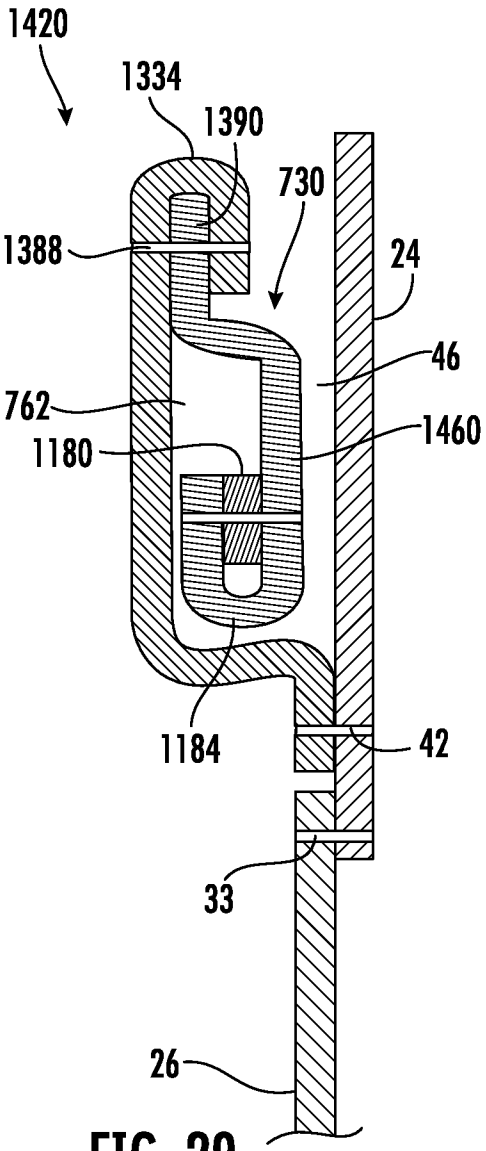
FIG. 29 is a sectional view of an example garment taken along line 21-21 of FIG. 20.
Figure 28:
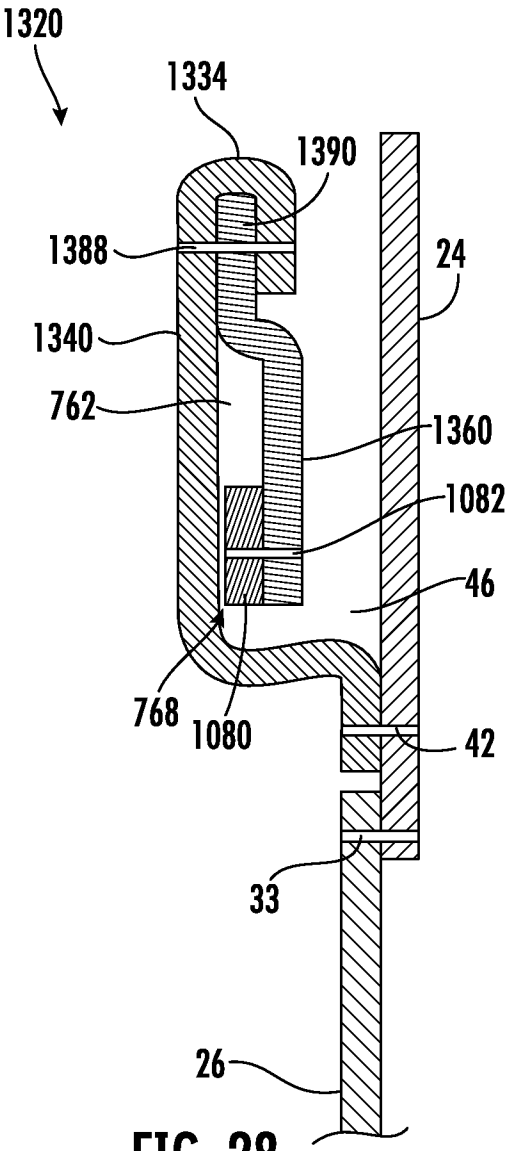
FIG. 28 is a sectional view of an example garment taken along line 21-21 of FIG. 20.

FIGS. 28-30 are sectional views illustrating examples of alternative pocket retainers that are affixed to the pocket panel. In each of FIGS. 28-30, the pocket panel has a top folded edge portion, but wherein the pocket retainer is not formed by a downward extension of the pocket panel. Instead, the pocket retainer is affixed to the pocket wall at a location within the top folded edge portion.

FIG. 28 is a sectional view illustrating portions of an example garment 1320. Garment 1320 is similar to garment 1020 except that garment 1320 comprises pocket panel 1340 and pocket retainer 1360 in place of pocket panel 740 and pocket retainer 1060. Those remaining components of garment 1320 which correspond to components of garment 1020 are numbered similarly and/are our shown in FIGS. 20-22 and 25.

Pocket panel 1340 is similar to pocket panel 740 except that comprises top folded edge portion 1334 in lieu of top folded edge portions 734. Top folded edge portion 1324 inwardly curls or wraps about an upper portion of pocket retainer 1360, being secured to pocket retainer 1360 by stitching 1388. In other implementations, top folded edge portion 1324 may be secured to pocket retainer 1360 by welds, adhesives or other fastening techniques.

Pocket retainer 1360 is similar to pocket retainer 1060 described above with respect to FIG. 25 except that rather than comprising an integral extension of pocket panel 1340, pocket retainer 1360 has an upper end portion 1390 sandwiched within top folded edge portion 1334 of pocket panel 1340 and secured within the top folded edge portion 1334 by stitching 1388. In other implementations, in lieu of stitching 1388, welding/fusing or adhesives may be used. Those remaining components of pocket retainer 1360 which correspond to components of pocket retainer 1060 are numbered similarly. Because pocket retainer 1360 is a separate component mounted to pocket panel 1340, pocket retainer 1360 may be formed from material different than that of pocket panel 1340. For example, pocket retainer 1360 may be elastic as compared to pocket panel 1340 for providing enhanced retention of articles within retention space 762.

FIG. 29 is a sectional view illustrating portions of an example garment 1420. Garment 1420 is similar to garment 1320 except that garment 1420 comprises pocket retainer 1460 in lieu of pocket retainer 1360. Pocket retainer 1460 is similar to pocket retainer 1160 described above with respect to FIG. 26 except that rather than comprising an integral extension of pocket panel 1340, pocket retainer 1460 has an upper end portion 1390 sandwiched within top folded edge portion 1334 of pocket panel 1340 and secured within the top folded edge portion 1334 by stitching 1388. In other implementations, in lieu of stitching 1388, welding/fusing or adhesives may be used. Those remaining components of pocket retainer 1460 which correspond to components of pocket retainer 1160 are numbered similarly.

FIG. 30 is a sectional view illustrating portions of an example garment 1520. Garment 1520 is similar to garment 1320 except that garment 1520 comprises pocket retainer 1560 in lieu of pocket retainer 1360. Pocket retainer 1560 is similar to pocket retainer 1260 described above with respect to FIG. 27 except that rather than comprising an integral extension of pocket panel 1340, pocket retainer 1560 has an upper end portion 1390 sandwiched within top folded edge portion 1334 of pocket panel 1340 and secured within the top folded edge portion 1334 by stitching 1388. In other implementations, in lieu of stitching 1388, welding/fusing or adhesives may be used. Those remaining components of pocket retainer 1560 which correspond to components of pocket retainer 1260 are numbered similarly.

Figure 33:
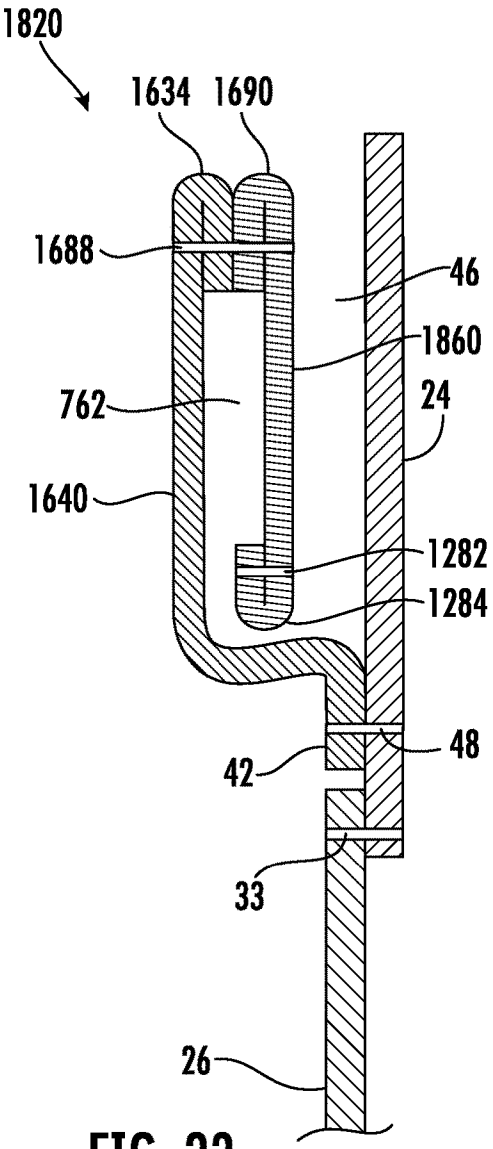
FIG. 33 is a sectional view of an example garment taken along line 21-21 of FIG. 20.
Figure 32:
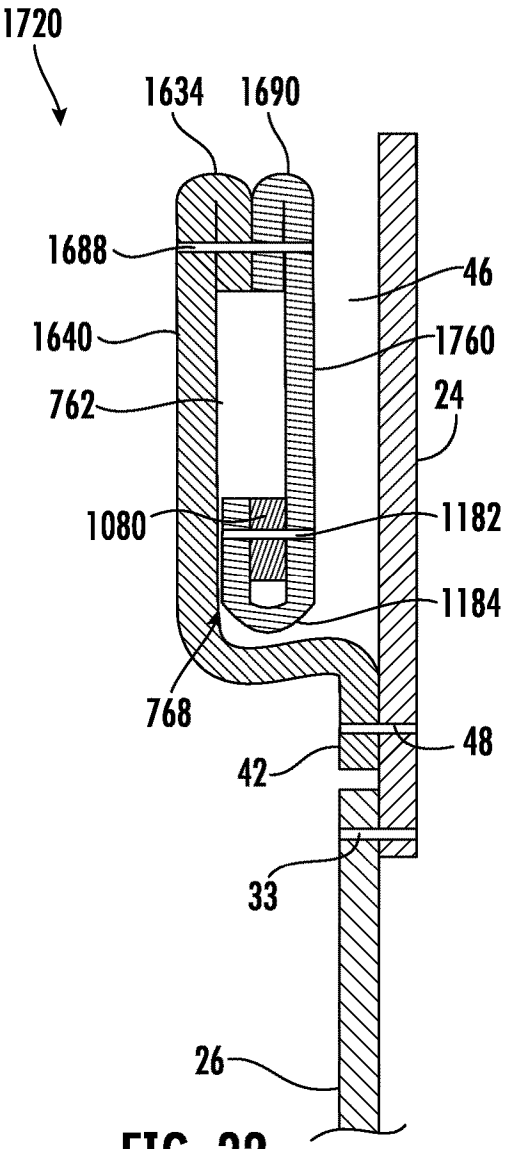
FIG. 32 is a sectional view of an example garment taken along line 21-21 of FIG. 20.
Figure 31:
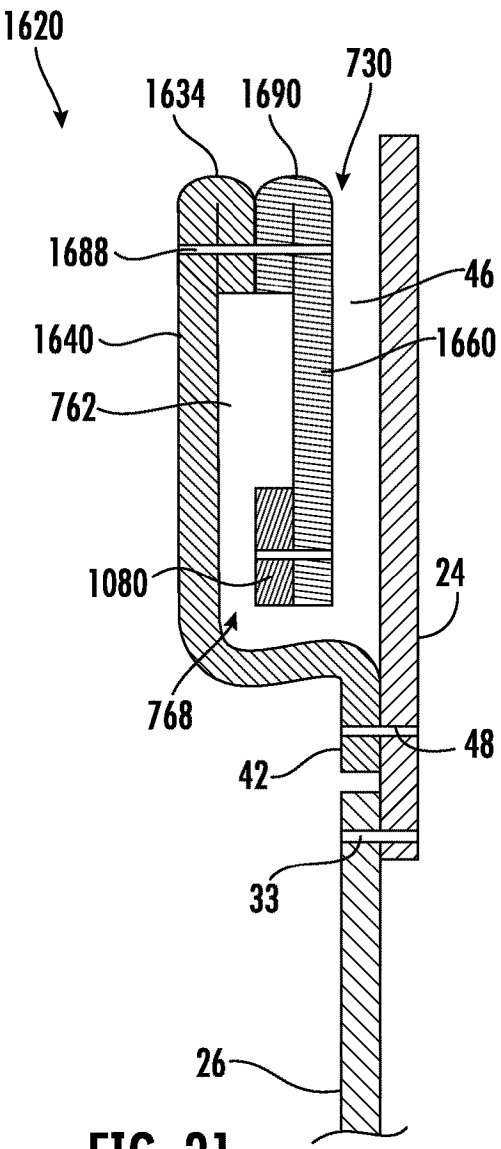
FIG. 31 is a sectional view of an example garment taken along line 21-21 of FIG. 20.

FIGS. 31-33 are sectional views illustrating examples of alternative pocket retainers that are affixed to the pocket panel. In each of FIGS. 31-33, the pocket panel has a top folded edge portion and the pocket retainer also has a top folded edge portion. The top folded edge portions extend along one another and are secured to one another by stitching, welding or adhesives.

FIG. 31 is a sectional view illustrating portions of an example garment 1620. Garment 1620 is similar to garment 1020 except that garment 1320 comprises pocket panel 1640 and pocket retainer 1660 in place of pocket panel 740 and pocket retainer 1060. Those remaining components of garment 1620 which correspond to components of garment 1020 are numbered similarly and/are our shown in FIGS. 20-22 and 25.

Pocket panel 1640 is similar to pocket panel 740 except that pocket panel 1640 comprises top folded edge portion 1634 in lieu of top folded edge portions 734. Top folded edge portion 1634 inwardly curls and is secured to itself by stitching 1688. In other implementations, top folded edge portion 1634 may be secured to itself by welds, adhesives or other fastening techniques.

Pocket retainer 1660 is similar to pocket retainer 1060 described above with respect to FIG. 25 except that rather than comprising an integral extension of the pocket panel, pocket retainer 1660 has an upper end portion that is outwardly curled to form top folded edge portion 1690 and is secured to itself by stitching 1688. In other implementations, in lieu of stitching 1688, welding/fusing or adhesives may be used. Those remaining components of pocket retainer 1660 which correspond to components of pocket retainer 1060 are numbered similarly.

In the example illustrated, a single set of stitching 1688 joins both of folded edge portions 1634 and 1690. In other implementations, folded edge portions 1634 and 1690 may each be secured by separate stitching, wherein a third stitching joins both of the individually pre-stitched folded edge portions 1634, 1690. As noted above, in lieu of stitching, the various junctures or connection may provide bite the sieves or welding/fusing. The inwardly curled folded edge portions 1634 and the outwardly curled folded edge portion 1690 form a rounded, robust upper edge or border for upward facing waist pocket 730. The inwardly curled folded edge portions 1634 and the outwardly curled folded edge portion 1690 further cooperate to define an enlarged width for retention space 762.

FIG. 32 is a sectional view illustrating portions of an example garment 1720. Garment 1720 is similar to garment 1620 except that garment 1720 comprises pocket retainer 1760 in lieu of pocket retainer 1660. Pocket retainer 1760 is similar to pocket retainer 1160 described above with respect to FIG. 26 except that rather than comprising an integral extension of pocket panel 1340, pocket retainer 1760 has an upper end portion that is outwardly folded and joined to pocket panel 1640 in a fashion similar to that described above with respect to FIG. 31. As described above, top folded edge portions 1690 and 1634 are joined to one another by stitching 1688. In other implementations, in lieu of stitching 1388, welding/fusing or adhesives may be used. Those remaining components of pocket retainer 1760 which correspond to components of pocket retainer 1160 are numbered similarly.

FIG. 33 is a sectional view illustrating portions of an example garment 1820. Garment 1820 is similar to garment 1620 except that garment 1820 comprises pocket retainer 1860 in lieu of pocket retainer 1660. Pocket retainer 1860 is similar to pocket retainer 1260 described above with respect to FIG. 27 except that rather than comprising an integral extension of the pocket panel, pocket retainer 1860 has an upper end portion that is outwardly folded and joined to pocket panel 1640 in a fashion similar to that described above with respect to FIG. 31. As described above, top folded edge portions 1690 and 1634 are joined to one another by stitching 1688. In other implementations, in lieu of stitching 1388, welding/fusing or adhesives may be used. Those remaining components of pocket retainer 1860 which correspond to components of pocket retainer 1160 are numbered similarly.

Garments 1320, 1420, 1520 1620, 1720, and 1820 in FIGS. 28-33 are each illustrated as having pocket panel secured to waistband 24 in the same fashion as garment 720. In particular, each of such garments is illustrated as having a lower end portion 42 extending downwardly and flat against waistband 24 while being secured to waistband 24 by stitching 48. In other implementations, each of such garments may alternatively have the pocket panel joined to waistband 24 in a fashion similar to that shown in FIGS. 23 and 24, wherein the lower edge portion of the pocket panels upwardly folded or curled and secured along waistband 24.

Figure 34:
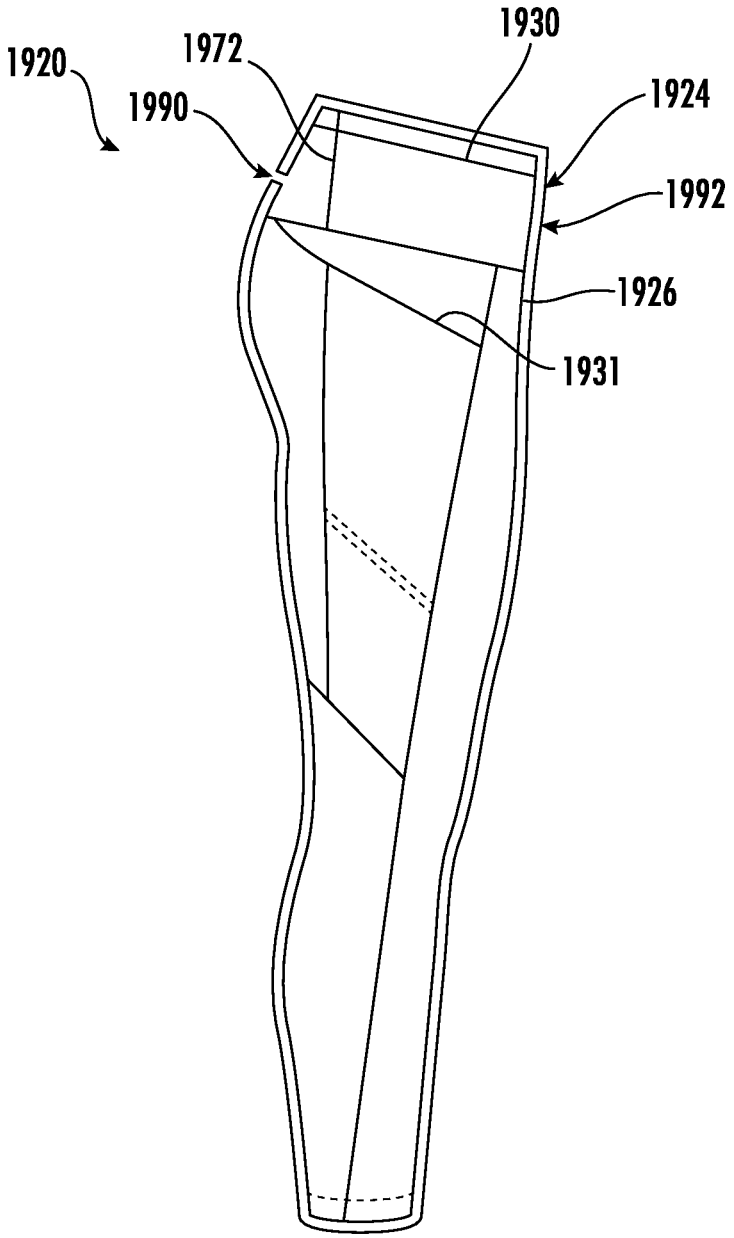
FIG. 34 is a right side view of an example garment.
Figure 40:
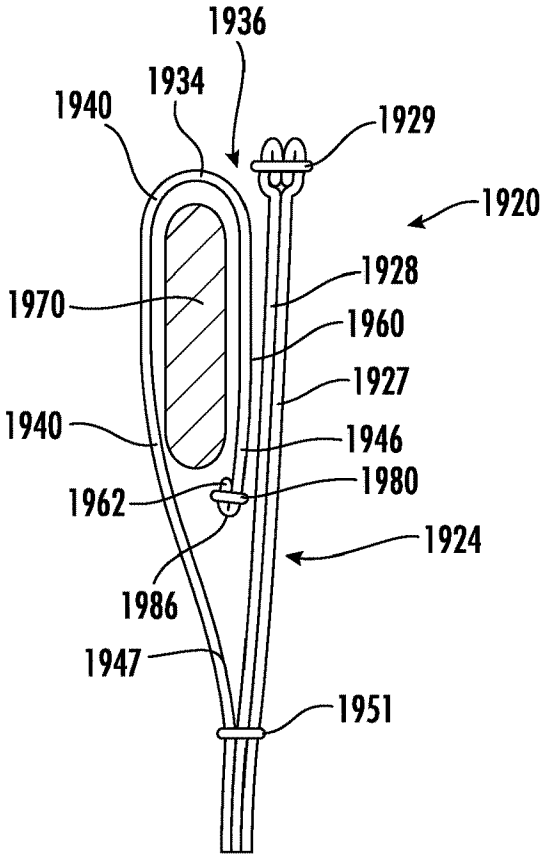
FIG. 40 is a sectional view of a rear portion of the garment of FIG. 38.
Figure 39:
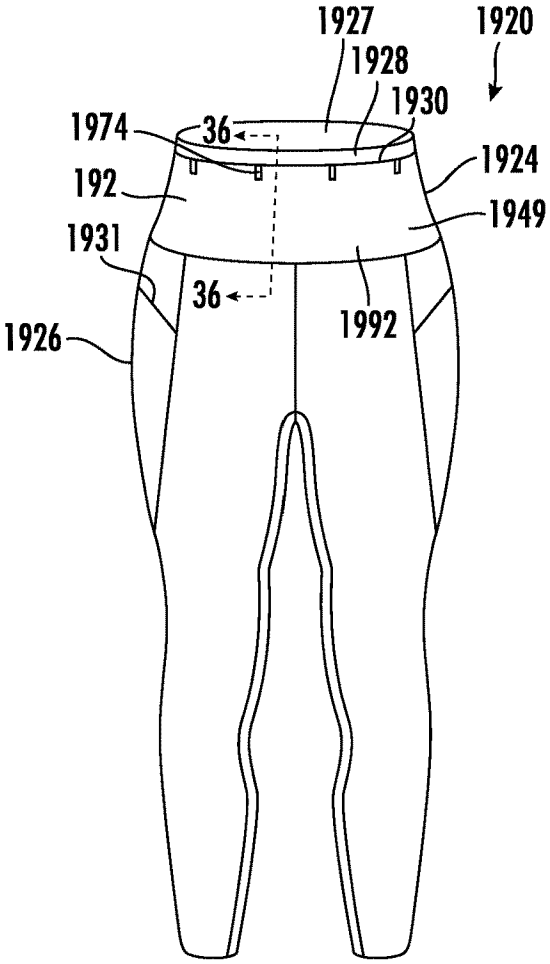
FIG. 39 is a front view of an example garment.
Figure 38:
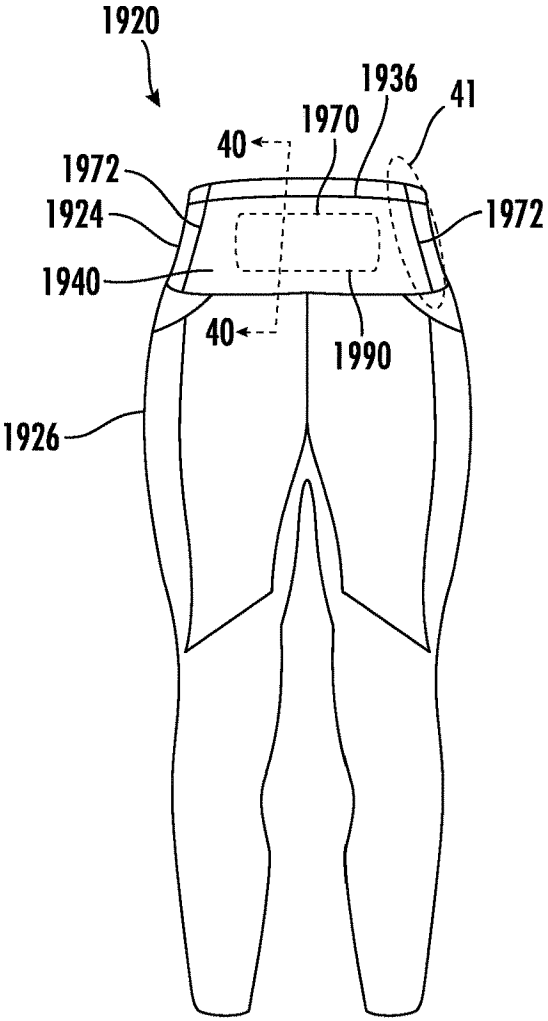
FIG. 38 is a rear view of an example garment.
Figure 41:
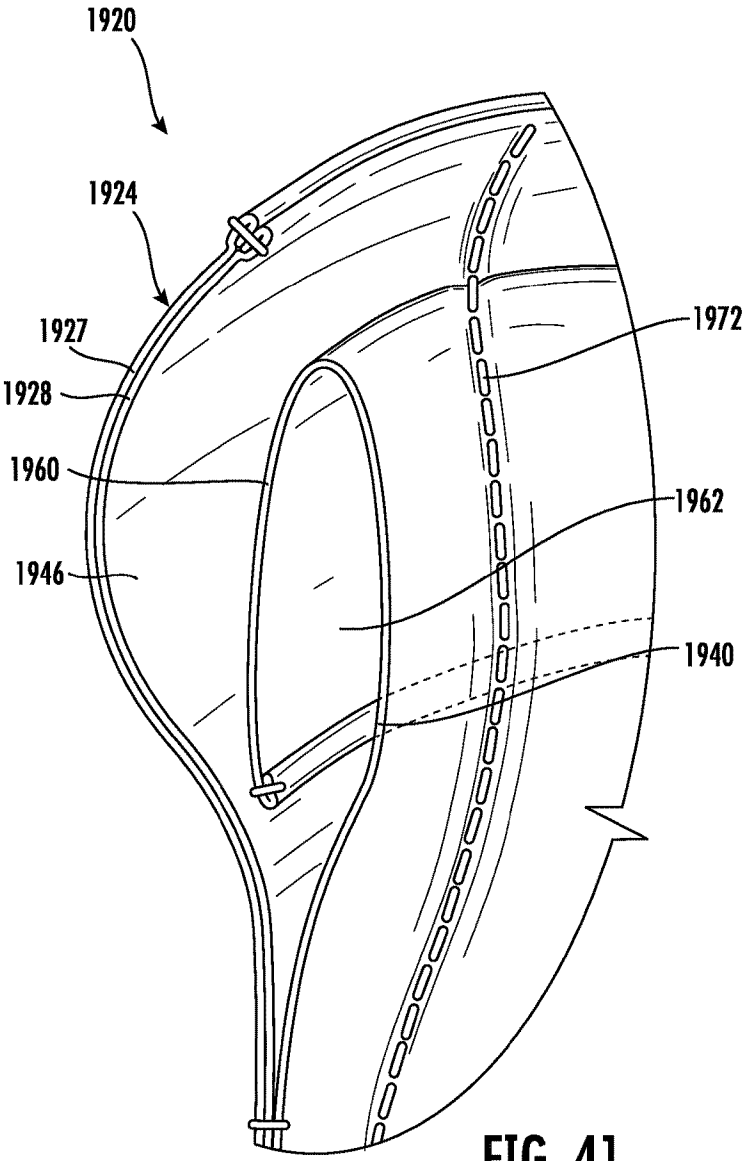
FIG. 41 is a sectional view of a rear portion of the garment of FIG. 38.

FIGS. 34-36 and 38-41 illustrate portions of an example garment 1920. FIG. 34 is a right-side view of garment 1920, wherein the left side of garment 1920 is a mirror image of the right side image shown in FIG. 34. FIG. 38 illustrates a rear view of garment 1920. FIG. 39 illustrates a front portion of garment 1920. FIG. 40 illustrates a cross-sectional view of a waistband 1924 of the garment 1920, and FIG. 41 illustrates a cutaway perspective view of waistband 1924 of the garment.

Referring to FIGS. 34-36 and 38-41, garment 1920 comprises a piece of clothing or apparel such as a pair of leggings worn about the waist of a person. Garment 1920 comprises a waistband 1924, a lower extension 1926, an first upward facing waist pocket 1930, a second upward facing waist pocket 1936 and a retention space 1962. Garment 1920 facilitates more secure retention of articles, such as a cellphone 1970, about the waistband 1924 of the garment 1920. In the implementation of FIGS. 34-36 and 38-41, the waistband 1924 includes a pair of vertical seams 1972 that, with the other components of the waistband 1924, define the first upward facing waist pocket 1930 and a second upward facing pocket 1936 and a retention space 1962. The first upward facing waist pocket 1930 extends from one of the vertical seams 1972 forward about or across the front of the waistband 1924 and along the front sides of the waist band 1924 to the other of the vertical seams 1972. The second upward facing waist pocket 1936 and the retainer space 1960 extend between the vertical seams 1972 along the rear of the waistband 1924 of the person wearing the garment. The retainer space is formed by a pocket panel 1940 and an internal pocket retainer 1960 that also extend between the vertical seams along the rear of the waistband 1924.

Waistband 1924 comprises a pair of panels comprising an inner panel 1927 and an outer panel 1928 which form inner and outer layers, respectively, which are joined to one another by stitching 1929. Waistband 1924, like waistband 24, is configured to extend about the waist of a person wearing garment 1920 along or about the person's waistline. In some implementations, waistband 1924 may be continuous or uninterrupted, lacking ends. In some implementations, waistband 1924 may comprise opposite ends which are permanently joined to one another by stitching, bonding or the like. In implementations where waistband 24 is continuous, a person may step into waistband 1924 when donning garment 20. In some implementations, waistband 1924 may comprise end portions which are releasably connected to one another by a hook and loop fastener, buttons, clasps, hooks, or a buckle, permitting waistband 24 to be opened and wrapped about the waist of the person. In some implementations, such as the implementation of FIGS. 34-36 and 38-41, the waistband 1924 is elastic or resiliently stretchable. In some implementations, waistband 1924 may be inelastic. Each of the waistbands 24 described above with respect to FIGS. 1-34 may have a waistband configured similar to that of waistband 1924.

Lower extension 1926 comprises one or more panels extending downwardly from a lower edge portion of waistband 1924 and configured to cover at least upper portions of the groin and buttocks of the person wearing garment 1920. In the example illustrated, lower extension 1926 continues further to cover the person's thighs, knees, calves and shins, forming pant legs. In other implementations, lower extension 1926 may have various configurations depending upon the type of garment 1920. For example, lower extension 1926 may be shorter such as where garment 1920 comprises a pair of shorts, a skirt or the like.

In the example illustrated, lower extension 1926 additionally comprises pockets 1931 which have mouths below the bottom edge of waistband 1924. In some implementations, lower extension 1926 may include one or more openings that may be openable and closable with a zipper, buttons, snaps or the like. Lower extension 1926 may be pleated.

Figure 35:
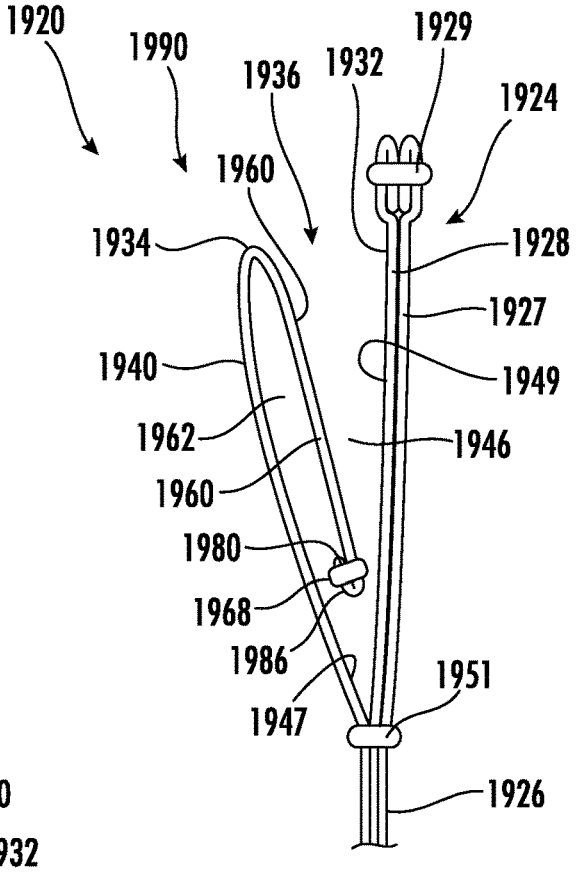
FIG. 35 is a sectional view of a rear portion of the garment of FIG. 34.
Figure 36:
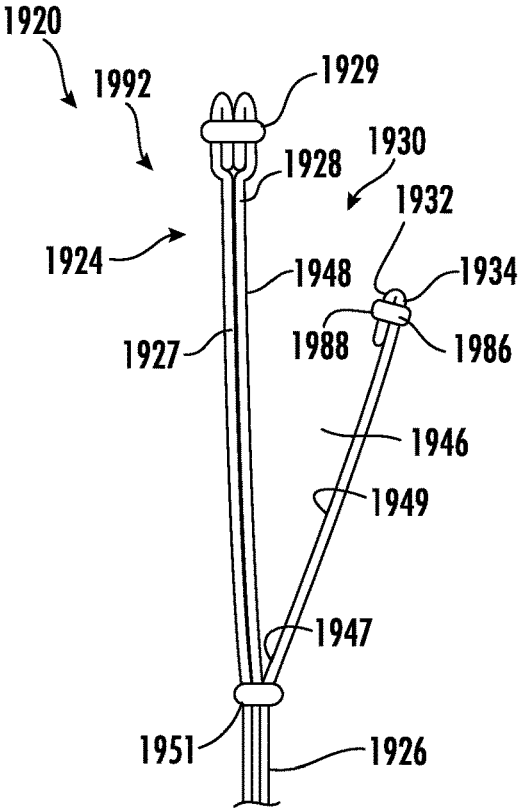
FIG. 36 is a sectional view of a front portion of the garment of FIG. 34.

First upward facing waist pocket 1930 comprises a pocket coupled to waistband 1924 along an exterior of waistband 1924. In the example illustrated, the first and second upward facing waist pockets 1930 and 1936 continuously extends along and about waistband 1924 but for vertical seams 1972. Vertical seams 1972 extend on the left and right rear sides of garment 1920 and partition a top of garment 1920 into a rear portion 1990 having the second upward facing pocket 1936 and a front portion 1992 having the first upward facing pocket 1930. FIG. 35 is a sectional view of rear portion 1990. FIG. 40 is a sectional view of the rear portion 1990 taken about line 40-40 of FIG. 38 and includes the cellphone 1970 as an example of an article. FIG. 36 is a sectional view of front portion 1992.

As shown by FIGS. 35, 38 and 40, the second upward facing waist pocket 1936 is formed by pocket panel 1940 which is joined to lower extension 1926 and waistband 1924 by stitching 1951. Pocket panel 1940 extends or rises upwardly from stitching 1951, forming an outermost wall of pocket 1930. As shown by FIGS. 35 and 40 in the rear portion 1990, pocket panel 1940 continues extending inwardly into pocket 1930 from folded edge portion 1934 to form pocket retainer 1960. Pocket panel 1940 is folded inwardly to form top folded edge portion 1934.

The pocket 1930 has a waist pocket interior 1946 having a floor 1947, a front or outer wall 1949, the pocket retainer 1969 and a top mouth or top opening 1932. Top opening 1932 facilitates access to the interior of upward facing waist pocket 1930 for the insertion of articles into the interior. In some implementations, top opening 1932 may comprise a closure mechanism such as a zipper, and loop fastener or other mechanisms. In other implementations, top opening 1932 may omit any closure mechanism.

Pocket retainer 1960 is integrally formed as a single unitary body as part of pocket panel 1940. Pocket retainer 1960 extends from folded edge portion 1934 towards floor 1947 to form retention space 1962. The lower end 1986 of pocket retainer 1960 is outwardly curled or folded and attach to itself by stitching 1980 to form a lower hem wall along the downwardly facing mouth 1968 of retention space 1962. Retention space 1962 comprises volume into which articles may be inserted. In particular, articles are first inserted through top opening 1932 into the interior 1946 of pocket 1930. In instances where additional retention is desired, such articles may further be positioned into retention space 1962 through mouth 1968. As a result, articles positioned within retention space 1962 are vertically captured between top folded edge portion 1934 and floor 1947, inhibiting accidental dislodging of such articles. Referring to FIG. 40, the pocket panel 1940, the pocket retainer 1960 including its lower end 1986 together with the inner and outer panels 1927 and 1928 of the waistband 1924 secure the cellphone 1970 or other article securely and inhibit excessive movement or bouncing of the cellphone 1970 when worn by the wearer engaging in physical activities. The structure along with the resilient nature of the material used to form these components helps to keep the cellphone 1970 secure when positioned within the retention space 1962.

Vertical seams 1972 comprise stitching that extends through and joins a front of pocket panel 1940, pocket retainer 1960 and waistband 1924, closing off the sides of both pocket 1930 and retention space 1962. The vertical seams 1972 assist in maintaining the shape and configuration of pocket 1930 and retention space 1962 by limiting the extent that pocket panel 1940 and pocket retainer 1960 may be pulled away from waistband 1924. Referring to FIG. 41, the stitching of the vertical seams 1972 is shown closing off the sides of interior 1946 of the second upward facing pocket 1936 and the retention space 1962. So, both volumes of the waistband 1924 (the interior 1946 and the retentions space 1962) are closed off at the ends by the vertical seam 1972.

As shown by FIGS. 36 and 39, in front portion 1992, garment 1920 omits pocket retainer 1960. Instead, those portions of pocket panel 1940 extending below top folded edge portion 1934 and within interior 1946 of pocket 1930 are affixed to the outer wall of pocket panel 1940 by stitching 1980 to form an inner hem 1988 along the mouth 1932 of pocket 1930 in front portion 1992. In the example illustrated, the omission of pocket retainer 1960 along front portion 1992 reduces the weight and thickness of the garment 1920 about the person's waist. Referring to FIG. 39, the front portion 1992 can include one or more bar tacks 1974 at the mouth 1932 of the first upward facing pocket 1930. When two or more bar tacks 1974 are employed they are positioned in a spaced-apart manner along the front portion 1992 of the waistband 1924 to separate out individual pocket entry points into the interior 1946.

In other implementations, pocket retainer 1960 may alternatively also extend along front portion 1992. In some implementations, pocket retainer 1960 may provide along front portion 1992, wherein rear portion 1990 omits pocket retainer 1960. In some implementations, garment 1920 may comprise multiple enhanced article retention regions where a pocket retainer 1960*s* provided, wherein such regions may be separated by regions that omit a pocket retainer. In some implementations, garment 1920 may be provided with a pocket retainer continuously extending about waistband 1924. In some implementations, additional sets of vertical seams 1972 may be provided along waistband 1924. In some implementations, in lieu of the stitching shown, such panels or layers may be affixed or joined to one another by welds or adhesives. In some implementations, vertical seams 1972 extend between and connect the outer wall of pocket panel 1940 and pocket retainer 1960, independent of the inner wall of pocket 1930 provided by waistband 1924.

Figure 42:
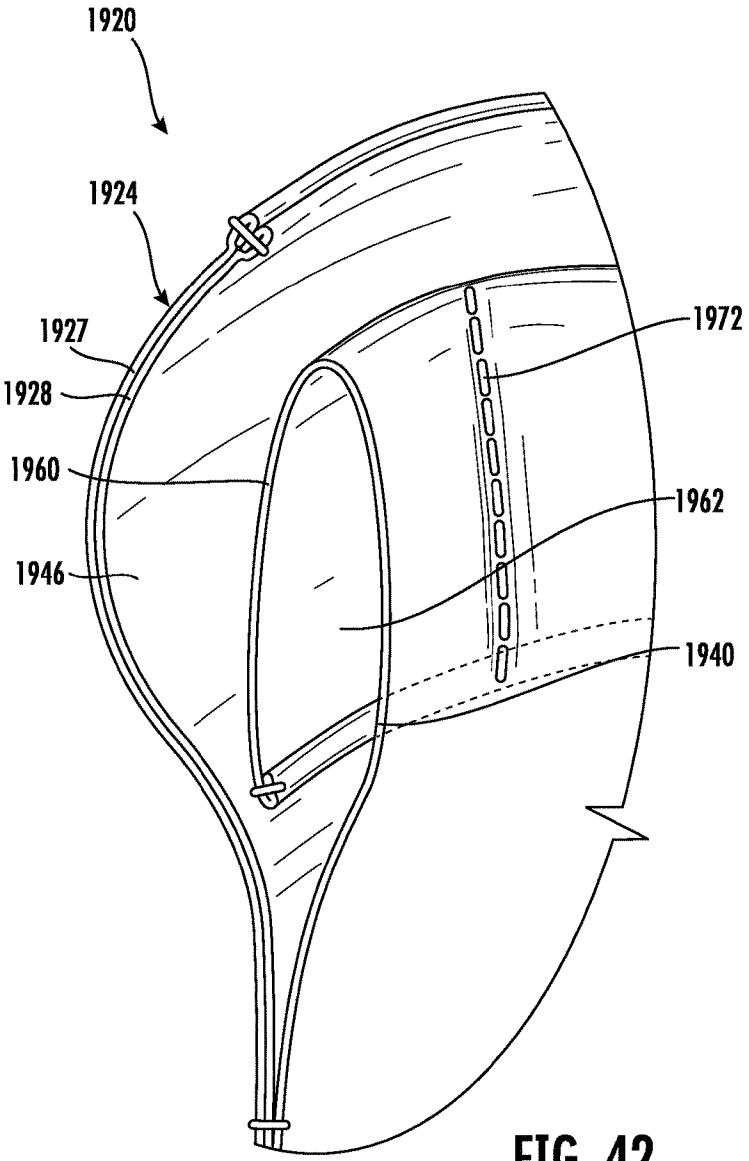
FIG. 42 is a sectional view showing another implementation of the rear portion of the garment of FIG. 38.

Referring to FIG. 42, in some implementations, the vertical seams 1972 can comprise stitching that extends through and joins the pocket panel 1940 and pocket retainer 1960 but does not also join the pocket panel 1940 and the pocket retainer 1960 to the inner and outer panels 1927 and 1928 of the waistband 1924. Rather, only the top and bottom of the inner and outer panels 1927 and 1928 can be connected to the top and bottom of the pocket panel 140 and the pocket retainer 1960 of the waistband 1924. Therefore, stitching of the vertical seam 1972 is shown closing off the sides of the retention space 1962 but not closing off the end of the interior 1946.

Although vertical seams 1972 continuously extend from a top to a bottom of waistband 1924 connecting the pocket panel 1940 and the pocket retainer 1960 thereby closing off the ends of the retention space 1962, the vertical seams 1972 may comprise only tacks that extend along a top portion, a bottom portion of the waistband 1924 between the in the location shown such that interior 1946 of the second upward facing pocket 1934 can be continuous with the first upward facing pocket providing a collective continuous pocket that can extend 360 degrees about the waistband 1924.

Figure 37:
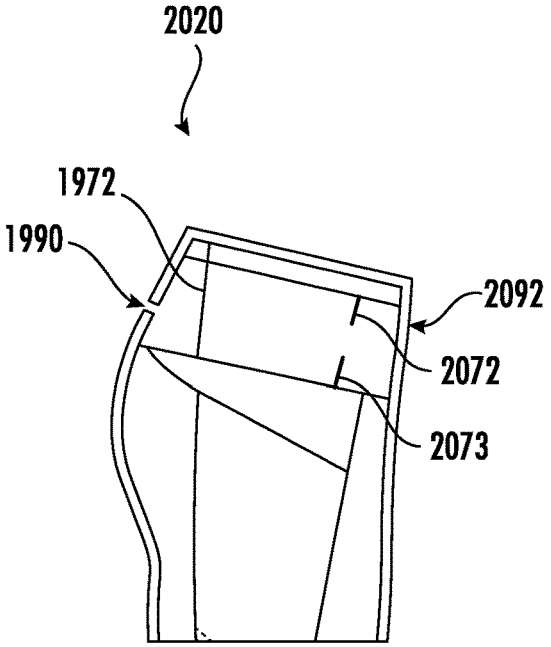
FIG. 37 is a right side view of an example garment.

FIG. 37 is a side view illustrating portions of an example garment 2020. Garment 2020 is in the form of a pair of shorts. Garment 2020 is similar to garment 1920 described above except that garment 20 comprises a front portion 2092 extending from vertical seams 1972. Those remaining portions of garment 2020 which correspond to components of garment 1920 are numbered similarly and/or are shown and described above with respect to FIGS. 34-36.

Front portion 2092 has a sectional configuration similar to the section shown in FIG. 35. As a result, garment 2020 comprises a plurality of upwardly facing waist pockets one and rear portion 1990 and one in front portion 2092) and a plurality of corresponding pocket retainers (one in rear portion 1990 and one in front portion 2092). In the example illustrated, front portion 2092 additionally comprises vertical tacks 2072 and 2073.

Vertical tack 2072 joins an upper portion of pocket panel 1940 and an upper portion of pocket retainer 1960 to waistband 1924. Tack 2072 comprises stitching that extends through and between each of the layers of material forming panel 1940, pocket retainer 1960 and at least one of the layers of material forming waistband 1924. Tack 2072 inhibits or limits the degree to which mouth 1932 of pocket 1930 may be opened.

Vertical tack 2073 joins a lower portion of pocket retainer 1960 to the front wall or portion of panel 1940. Vertical tack 2073 does not extend through and is not connected to waistband 1924 tack 2073 inhibits or limits the opening of mouth 1968 of retention space 1962. Without restricting the length of the interior 1946 of pocket 1930. In other implementations, tacks 2072 and 2073 may be omitted or may be replaced with a single vertical seams similar to seam 1972. In some implementations, tack 2073 may be additionally connected to waistband 1924. In some implementations, tack 2072 may not be connected to waistband 1924. The configurations shown with respect to garments 1920 and 2020 may be incorporated into other forms or types of garments.

In each of the above describe garments, the retention space formed by the pocket retainer is configured to contain loose articles and inhibit accidental dis-lodgment of such articles from the generally larger upward facing waist pocket. In each of the above describe garments, the retention space may have an internal height of at least one inch.

Each of the above described garments comprise an upward facing waist pocket having a depth, wherein the internal retention space has an internal height of at least 70% percent of the depth, and in some implementations, at least 2 inches. In each of the above described garments, the internal retention space may have a length (generally in the horizontal direction) of at least 4 inches. In each of the above describe garments, the upward facing waist pocket may have a depth, wherein the internal retention space has an internal height of at least 70% of such depth. In some implementations, the internal retention space provided by the pocket retainer may have an internal height substantially equal to the depth of the upward facing waist pocket.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A garment comprising:

a waistband forming a waist opening;

a lower extension extending downward from the waistband;

an upward facing waist pocket along an exterior of the waistband, the upward facing waist pocket having an interior, an upward facing mouth, and a bottom; and a pocket retainer within the upward facing waist pocket and forming an internal retention space having a downward facing retention space mouth, wherein the upward facing waist pocket has a depth and wherein the internal retention space has an internal height of at least 70% percent of the depth, wherein a single continuous unitary panel has a lower end affixed to the lower extension and comprises:

a first portion extending upwardly from the lower end and inwardly folding towards the waistband along a first fold, the first fold of the single continuous panel forming an inside surface of an upwardly facing mouth of the upward facing waist pocket; and a second portion extending downwardly from the fold within the upward facing waist pocket, a first face of the second portion forming a majority of one side of the interior of the upward facing waist pocket and a second opposite face of the second portion forming a majority of one side of the internal retention space; and a third portion extending from the second portion and inwardly folding towards the first portion along a second fold, the second fold forming an inside surface of the downwardly facing retention space mouth, the third portion being affixed to the second portion to form a hem wall.

2. The garment of claim 1, wherein the lower edge of the pocket retainer is elastic.

3. The garment of claim 1 and in an further comprising an elastic band affixed to and along the lower edge of the pocket retainer.

4. The garment of claim 1, wherein side portions of the pocket retainer are affixed along a vertical seam.

5. The garment of claim 1, wherein the pocket retainer extends less than 360 degrees along the waistband.

6. The garment of claim 1, wherein the retention space has an internal height of at least one inch.

7. The garment of claim 1, wherein the internal retention space has a length of at least 4 inches.

8. The garment of claim 1, wherein the depth of the upward facing waist pocket is a measurement from an opening of the upward facing pocket to the bottom of the upward facing pocket.

9. The garment of claim 8, wherein the internal height of the internal retention space as a height equal to the depth of the upward facing waist pocket.

10. The garment of claim 8, wherein the second portion extends to a lower portion adjacent to the bottom of the upward facing pocket.

11. The garment of claim 1, wherein the hem wall has a vertical height and wherein the hem wall is spaced from the floor by a distance less than the vertical height of the hem wall.

12. The garment of claim 1, wherein the single continuous panel extends 360 degrees about the waist opening and wherein the upwardly facing waist pocket comprising a continuous void extending, without interruption, from the lower extension to the first face of the second portion and from the upward facing mouth of the upward facing waist pocket downward to the downward facing retention space mouth.

13. A garment comprising:

a waistband forming a waist opening;

a lower extension extending downward from the waistband;

an upward facing waist pocket along an exterior of the waistband, the upward facing waist pocket having an interior, an upward facing mouth, and a bottom; and a pocket retainer within the upward facing waist pocket and forming an internal retention space having a retention space and a downward facing mouth, wherein the pocket retainer comprises a continuous unitary panel extending 360 degrees about the waist opening, the panel comprising:

an outer wall extending 360 degrees about the waist opening and forming a majority of a first interior surface of the internal retention space;

a retention space wall extending 360 degrees about the waist opening, the retention space wall having a first face forming a majority of a second interior surface of the internal retention space, this second interior surface facing the first interior surface, wherein the lower extension forms a first interior surface of the upwardly facing waist pocket and wherein a second face of the retention space wall forms a majority of a second interior surface of the upward facing waist pocket, the upwardly facing waist pocket comprising a continuous void extending, without interruption, from the lower extension to the second face of the retention space wall and from the upward facing mouth of the upward facing waist pocket downward to the downward facing mouth of the internal retention space;

a hem wall; and a flap folded edge portion between the retention space wall and the hem wall, wherein the hem wall extends along and within the retention space.

* * * * *